US008469349B2

(12) United States Patent
Maeda

(10) Patent No.: US 8,469,349 B2
(45) Date of Patent: Jun. 25, 2013

(54) APPARATUS WHICH EXECUTES A JOB FOR INSERTING A SECOND SHEET INTO A PLURALITY OF FIRST SHEETS

(75) Inventor: Yuuki Maeda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 182 days.

(21) Appl. No.: 12/753,288

(22) Filed: Apr. 2, 2010

(65) Prior Publication Data

US 2010/0252984 A1 Oct. 7, 2010

(30) Foreign Application Priority Data

Apr. 6, 2009 (JP) ..... 2009-091821

(51) Int. Cl.
*G03G 15/00* (2006.01)

(52) U.S. Cl.
USPC ..... 270/58.32; 270/58.31; 399/382

(58) Field of Classification Search
USPC ..... 270/58.31, 58.32; 399/382
See application file for complete search history.

(56) References Cited

U.S. PATENT DOCUMENTS 7,444,109 B2 * 10/2008 Kimura ..... 399/382
7,651,081 B2 * 1/2010 Yokobori et al. ..... 270/58.23
7,862,029 B2 * 1/2011 Yokobori et al. ..... 271/3.14
8,002,258 B2 * 8/2011 Nakagawa et al. ..... 270/58.32
8,045,912 B2 * 10/2011 Ushio ..... 399/382
8,078,078 B2 * 12/2011 Matsumoto ..... 399/82
2007/0274751 A1 * 11/2007 Ushio ..... 399/382

FOREIGN PATENT DOCUMENTS

JP 08-166744 A 6/1996
JP 2004-025550 A 1/2004
JP 2005-238817 A 9/2005
JP 2007-041505 A 2/2007
JP 2007-171287 A 7/2007
JP 2008-158709 A 7/2008

* cited by examiner

*Primary Examiner* — Patrick Mackey
(74) *Attorney, Agent, or Firm* — Canon U.S.A., Inc. IP Division

(57) ABSTRACT

A method for controlling an apparatus which inserts a second sheet fed from a second sheet feeding unit into a plurality of first sheets that are fed from a first sheet feeding unit and discharged to a sheet stacking unit after an image is formed. The method includes setting a number of a plurality of sheets to be fed from the second sheet feeding unit as one set of second sheets, outputting the second sheets to the sheet stacking unit, receiving a confirmation request of the second sheets, and performing control to output a predetermined number of second sheets which corresponds to the set number from the second sheet feeding unit, when the confirmation request is received.

17 Claims, 19 Drawing Sheets

APPARATUS WHICH EXECUTES A JOB FOR INSERTING A SECOND SHEET INTO A PLURALITY OF FIRST SHEETS

BACKGROUND OF THE INVENTION

1. Field of the Invention

The present invention relates to an image forming apparatus, a method for controlling the image forming apparatus, and a storage medium.

2. Description of the Related Art

There is a conventional image forming apparatus that can operate in a tab slip sheet mode, according to which tab-attached sheets are inserted at predetermined positions of an output bundle that is composed of a plurality of sheets having an ordinary size, thereby generating an output document with heading and/or chapter tabs. For example, the tab-attached sheets to be used in this mode can be assembled as one set of a predetermined number of sheets. For example, five tab-attached sheets are one set of five sheets.

Further, another conventional image forming apparatus can operate in a slip sheet mode, according to which preprint sheets (i.e., sheets on which printing has been completed beforehand) are inserted as slip sheets, in addition to a front cover insertion mode. One set of a plurality of preprint sheets can be used in a case where the preprint sheets are inserted as slip sheets, similar to the above-described insertion of the tab-attached sheets. For example, preprint sheets on which chapter numbers are printed beforehand are one set of a plurality of sheets.

In the above-described image forming apparatuses, in a case where one set of a plurality of insertion sheets are inserted, if any one of the insertion sheets is disordered, all of a great amount of output products may be uselessly output. Hence, to confirm any disorder of the insertion sheets to be inserted, a conventional technique discussed in Japanese Patent Application Laid-Open No. 2007-171287 uses a sensor capable of reading a mark printed at a predetermined position of each insertion sheet to be inserted.

Further, a conventional technique discussed in Japanese Patent Application Laid-Open No. 2005-238817 includes reading an image of a predetermined insertion sheet beforehand, reading an image of an insertion sheet at insertion timing of the insertion sheet, and collating the image of the insertion sheet actually inserted with the image registered beforehand.

However, the above-described method discussed in Japanese Patent Application Laid-Open No. 2007-171287 includes performing preliminary printing of the above-described mark at the predetermined position. The print of the mark remains uselessly on an output product. Further, a printer equipped with a special sensor capable of reading the above-described mark is to be used. Further, the image forming apparatus capable of recognizing a sensor reading position and the shape of a mark is used when the printing is performed. Further, the method discussed in Japanese Patent Application Laid-Open No. 2005-238817 includes acquiring all images beforehand and, as a result, increases user's labor in a printing environment in which a great amount of pages are processed. In this respect, the method discussed in Japanese Patent Application Laid-Open No. 2005-238817 is not efficient.

SUMMARY OF THE INVENTION

According to an aspect of the present invention, an apparatus inserts a second sheet fed from a second sheet feeding unit into a plurality of first sheets that are fed from a first sheet feeding unit and discharged to a sheet stacking unit after an image is formed. The image forming apparatus includes a setting unit configured to set a setting number of a plurality of sheets to be fed from the second sheet feeding unit as one set of second sheets, an output unit configured to output the second sheets to the sheet stacking unit, a receiving unit configured to receive a confirmation request of the second sheets, and a control unit configured to control the output unit to output a predetermined number of second sheets to the sheet stacking unit from the second sheet feeding unit, when the receiving unit has received the confirmation request.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
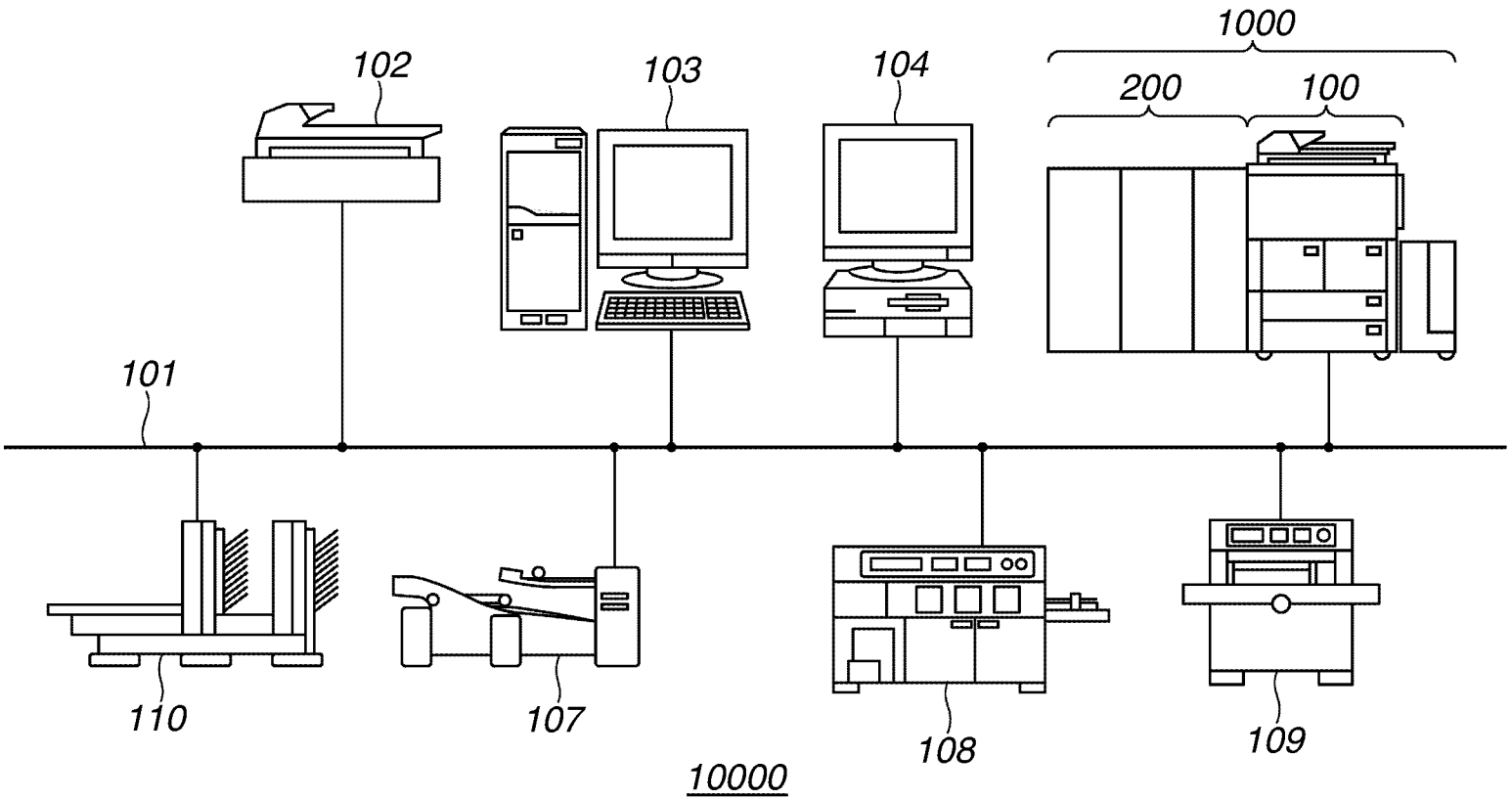
FIG. 1 illustrates a system configuration of an example of a printing system according to an exemplary embodiment of the present invention.

FIG. 1 illustrates a system configuration of an example of a printing system, which includes an image forming apparatus, according to a first exemplary embodiment of the present invention. The printing system according to the present exemplary embodiment is a Print On Demand (POD) system. The image forming apparatus according to the present exemplary embodiment is configured to insert a second sheet fed from a second sheet feeding unit into a bundle of first sheets that are fed from a first sheet feeding unit and discharged to a first sheet discharging unit after image is formed. More specifically, the image forming apparatus according to the present exemplary embodiment performs processing for inserting a sheet fed from the second sheet feeding unit into a plurality of sheets fed from the first sheet feeding unit. Hereinafter, a POD system 10000 including a printing system 1000 is described below.

In FIG. 1, the POD system 10000 includes, as constituent components, the printing system 1000 according to the present exemplary embodiment, a server computer 103 (hereinafter, referred to as "PC 103"), and a client computer 104 (hereinafter, referred to as "PC 104"). The POD system 10000 further includes a sheet folding machine 107, a sheet cutting machine 109, a saddle stitch binding machine 110, a case binding machine 108, and a scanner 102. The above-described constituent components can communicate with each other via a network 101. The printing system 1000 includes, as constituent components, a printing apparatus 100 and a sheet processing apparatus 200. In the present exemplary embodiment, an example of the image forming apparatus included in the printing system 1000 is a multifunction peripheral (MFP) that can perform a plurality of functions. However, the image forming apparatus according to the present exemplary embodiment is not limited to the above-described MFP and can be configured as a single function peripheral (SFP) that performs only one function. An example of the SFP is an ordinary printer apparatus.

The scanner 102 can perform processing for reading an image of an original document, generating image data from the read image, and transmitting the generated image data to the PC 103, the PC 104, and the printing system 1000.

Each of the PC 103 and the PC 104 can perform processing for generating image data using an application software, adding print settings to the generated image data, and transmitting the image data to the printing system 1000 via the network 101.

The sheet folding machine 107 can perform folding processing on printed sheets when the printed sheets are output from the printing apparatus 100. The case binding machine 108 can perform case binding processing on the sheets printed by the printing apparatus 100. The sheet cutting machine 109 can perform processing for cutting the sheets printed by the printing apparatus 100. The saddle stitch binding machine 110 can perform processing for saddle stitch binding the sheets printed by the printing apparatus 100. To enable these sheet processing apparatuses to perform various sheet processing operations, an operator is to perform a manual work for taking out a print product of a job which has been executed by the printing apparatus 100 from the sheet stacking unit of the printing apparatus 100 and placing the taken-out print product on the sheet processing apparatus.

Figure 2:
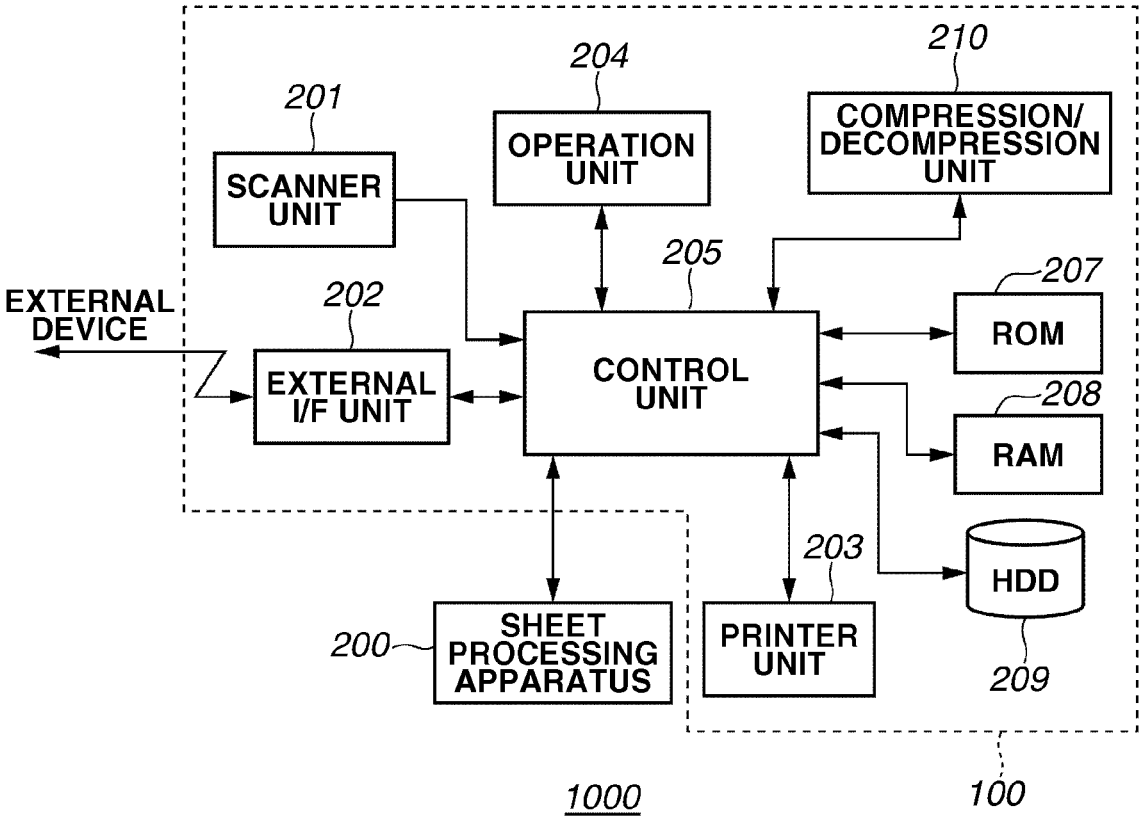
FIG. 2 is a block diagram illustrating an example configuration of the printing system.

FIG. 2 is a block diagram illustrating an example configuration (mainly, a software configuration) of the printing system illustrated in FIG. 1. The printing system 1000 is described below in more detail. In FIG. 2, the printing apparatus 100 includes a scanner unit 201, an external interface (I/F) unit 202, a printer unit 203, an operation unit 204, a control unit 205, a read only memory (ROM) 207, a random access memory (RAM) 208, a hard disk drive (HDD) 209, and a compression/decompression unit 210. The sheet processing apparatus 200 is detachably connected to the printing apparatus 100.

The scanner unit 201 can read an image of an original (e.g., a document) and can perform image processing on the read image data. The external I/F unit 202 can transmit and receive image data to and from a facsimile, a network connection device, and an external dedicated device.

The printer unit 203 can perform processing for printing job data (i.e., a print object) stored in the HDD 209 on a print medium. The operation unit 204 is an interface unit that can accept an operation performed by a user and an instruction input by the user. Further, the operation unit 204 includes buttons that can be operated to input instructions and a display unit that can display an operational state of the apparatus.

Another example of the user interface unit that can be provided by the printing system 1000 is, for example, a display unit, a keyboard, and a mouse of an external information processing apparatus that is functionally comparable to the PC 103 and the PC 104.

The control unit 205 can integrally control various processing and operations to be performed by a plurality of units that constitute the printing system 1000. The ROM 207 is a read only memory, which stores various control programs to be executed to perform various processing, including programs corresponding to flowcharts described below.

Further, the ROM 207 stores a display control program for performing various displays on the display unit of the operation unit 204. The control unit 205 causes the printing system 1000 to perform various operations according to the present exemplary embodiment. To this end, the control unit 205 is capable of reading out a program from the ROM 207 and executing the readout program.

The RAM 208 is a readable and writable memory, which stores image data transmitted from the scanner unit 201 and the external I/F 202 via a memory controller 206 together with various programs and setting information. The HDD 209 is a large-capacity storage device that can store print data of various jobs and control parameters. The control unit 205 stores print data of a job which has been input via various input units (e.g., the scanner unit 201 and the external I/F unit 202) in the HDD 209. Further, the control unit 205 controls the printer unit 203 to perform printing based on print data stored in the HDD 209. Further, the control unit 205 performs control to realize processing for transmitting print data stored in the HDD 209 to an external apparatus via the external I/F 202.

The compression/decompression unit 210 can perform processing for compressing and decompressing the image data stored in the RAM 208 or the HDD 209 according to various compression methods (e.g., Joint Bi-level Image Experts Group (JBIG), Joint Photographic Experts Group (JPEG), and the like). The printing apparatus 100 according to the present exemplary embodiment can be a printing apparatus capable of printing color images and a printing apparatus capable of printing monochrome images. The sheet processing apparatus 200 can perform post-processing on printed sheets that are output from the printer unit 203. The sheet processing apparatus 200 performs its operation according to an instruction supplied from the control unit 205.

Figure 3:
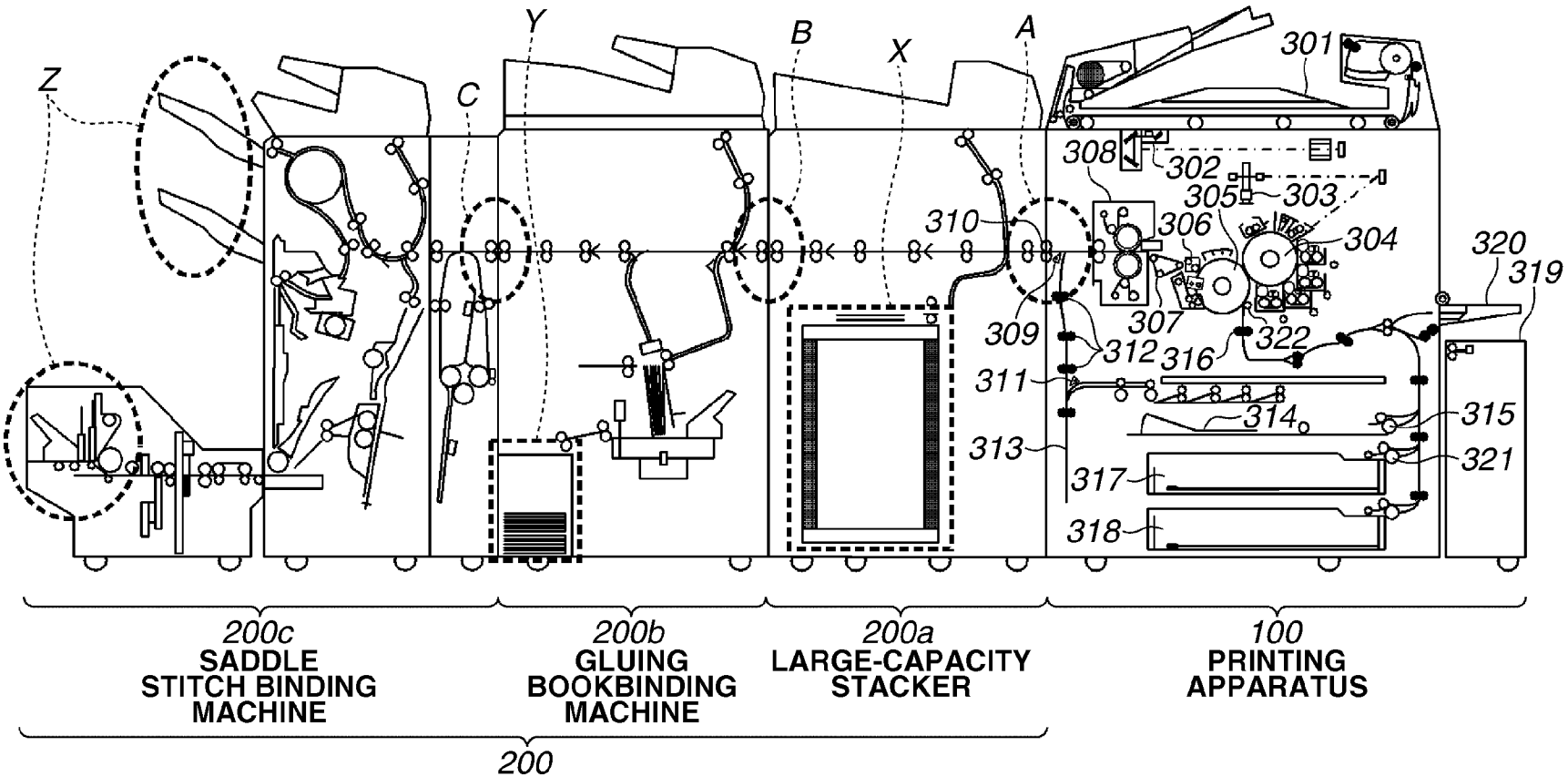
FIG. 3 is a cross-sectional view illustrating an example configuration of the printing system.

FIG. 3 is a cross-sectional view illustrating an example configuration of the printing system 1000 illustrated in FIG. 1. Hereinafter, an example configuration (mainly, a mechanical configuration) of the printing system 1000 and an example printing operation to be performed by the printing system 1000 are described below with reference to FIG. 3. To perform post-processing on printed sheets as described above, the printing system 1000 may include a plurality of in-line type sheet processing apparatuses that are connected together. In FIG. 3, the sheet processing apparatus 200 includes a large-capacity stacker 200*a*, a gluing bookbinding machine 200*b*, and a saddle stitch binding machine 200*c*, which are sequentially arrayed from an upstream side that is connected to the printing apparatus 100.

An automatic document feeder (ADF) 301 can successively separate sheets of an original bundle set on a stacking face of a document tray, from its first page, and successively convey the separated sheets onto a document positioning glass plate to cause a scanner 302 to scan the pages of the original according to the page order. The scanner 302 includes a charge coupled device (CCD) that can read an image of the original when the original is placed on the document positioning glass plate and can convert the read image into image data.

A rotating polygonal mirror 303 includes a reflection mirror that can reflect incident light (e.g., a laser beam) that is modulated according to image data toward a photosensitive drum 304, as scanning light, to irradiate a surface of the photosensitive drum 304 with the reflection light. A latent image formed on the photosensitive drum 304, for example, based on the above-described laser beam is developed with a toner to form a toner image. The toner image is then transferred onto a sheet held around a transfer drum 305. The printing apparatus 100 successively performs the above-described sequential processes for forming images of yellow (Y), magenta (M), cyan (C), and black (K) toners to form a full-color image.

After completing the above-described four times sequential image formation processes, the sheet on which the full-color image has been formed is separated from the transfer drum 305 by a separation claw 306 and is conveyed to a fixing device 308 by a pre-fixing conveyance device 307. The fixing device 308 includes a combination of rollers and belts, and also includes a heating source (e.g., a halogen heater). The fixing device 308 applies heat and pressure to the sheet to fuse and fix the toner images transferred on the sheet. A sheet discharge flapper 309 is configured to be swingable around its swing shaft and can regulate a conveyance direction of a sheet while it is conveyed.

When the sheet discharge flapper 309 swings in the clockwise direction on the drawing surface, the sheet can be conveyed straight and is discharged outside of the printing apparatus 100 via a pair of sheet discharge rollers 310. On the other hand, when images are formed on two surfaces of the sheet, the sheet discharge flapper 309 swings in the counterclockwise direction (on the drawing surface) to guide the sheet downward to a two-sided conveyance device. The two-sided conveyance device includes a reversing flapper 311, reversing rollers 312, a reversing guide 313, and a two-sided tray 314.

The reversing flapper 311 is configured to be swingable around its swing shaft and can regulate the conveyance direction of a sheet while it is conveyed. In a case where a job to be processed by the control unit 205 is a two-sided print job, the control unit 205 causes the reversing flapper 311 to swing in the counterclockwise direction on the drawing surface to guide a sheet after an image has been printed on its first surface by the printer unit 203, via the reversing rollers 312, to the reversing guide 313.

Then, the control unit 205 temporarily stops the reversing rollers 312 in a state where the rear end of the sheet is sandwiched between the reversing rollers 312. Subsequently, the control unit 205 causes the reversing flapper 311 to swing in the clockwise direction on the drawing surface. Further, the control unit 205 causes the reversing rollers 312 to rotate in the opposite direction. Through the above-described operation, the sheet is switched back and conveyed to the two-sided tray 314 in a state where the rear end and the front end of the sheet are switched.

The sheet is temporarily stacked on the two-sided tray 314 and is subsequently conveyed to registration rollers 316 via sheet re-feeding rollers 315. In this case, the sheet is conveyed in a state where a second surface (i.e., the surface opposite to the first surface) of the sheet is facing the photosensitive drum 304 during the transfer process. Then, similar to the above-described processes, an image of the second page is formed on the second surface of the sheet.

After two-sided image formation on both surfaces of the sheet is completed, the sheet is subjected to the fixing process and is discharged outside of the printing apparatus 100 via the sheet discharge rollers 310. The control unit 205 executes the above-described sequence for the two-sided print processing, thereby causing the printing apparatus 100 to perform two-sided printing for print data of a job (i.e., an object of the two-sided printing) on each of the first surface and the second surface of the sheet.

A sheet feeding conveyance device includes, as a sheet feeding unit configured to store sheets that can be used in print processing, sheet feeding cassettes 317 and 318 (e.g. each having a storage capacity comparable to 500 sheets), a paper deck 319 (e.g. having a storage capacity comparable to 5000 sheets), and a manual feed tray 320.

The printing apparatus 100 further includes a sheet feeding roller 321 and the registration rollers 316 each serving as a unit configured to feed sheets from the above-described sheet feeding units. The sheet feeding cassettes 317 and 318 and the paper deck 319 are configured to store various sheets that are different from each other in sheet size and/or material.

The manual feed tray 320 is configured to enable a user to manually feed various print media including special sheets (e.g., overhead projector (OHP) sheets). Each of the sheet feeding cassettes 317 and 318, the paper deck 319, and the manual feed tray 320 is equipped with the sheet feeding roller 321 to continuously send out the sheets one by one. More specifically, a pickup roller successively sends out the uppermost sheet of the stacked sheets from the sheet feeding unit. A separation roller, which is provided at a position facing the sheet feeding roller 321, prevents two sheets from being simultaneously fed. Thus, the sheets can be fed one after another to a conveyance guide.

In the present exemplary embodiment, the separation roller is urged by a driving force that can be transmitted via a torque limiter (not illustrated) so as to rotate in a direction opposed to the conveyance direction. When only one sheet is present in a nip portion formed between the sheet feeding rollers, the separation roller can rotate in the conveyance direction in accordance with the movement of the sheet.

On the other hand, if two or more sheets are present in the nip portion, the separation roller rotates in the direction opposed to the conveyance direction to return the overlapped sheets. Then, only one (i.e., the uppermost) sheet is fed. The sheet sent out in this manner is then guided along the conveyance guide and conveyed to the registration rollers 316 by a plurality of conveyance rollers.

The registration rollers 316 are stopped as an initial state. When the front end of the sheet collides with the nip portion formed between the registration rollers 316, the sheet deforms into a loop shape while correcting the skew of the sheet. Then, for image formation, the registration rollers 316 start rotating and convey the sheet in synchronization with a toner image formed on the photosensitive drum 304. The sheet fed by the registration rollers 316 is electro-statically attracted to the surface of the transfer drum 305 by an attracting roller 322. The sheet discharged from the fixing device 308 is then conveyed via the sheet discharge rollers 310 to a sheet conveyance path in the sheet processing apparatus 200. The control unit 205 executes the above-described printing operation.

Next, an example configuration of the in-line type sheet processing apparatus 200 included in the printing system 1000 is described below. A sheet printed in the printing apparatus 100 and discharged from the sheet discharge rollers 310 is conveyed via the sheet conveyance path to the large-capacity stacker 200*a*, or the gluing bookbinding machine 200*b*, or the saddle stitch binding machine 200*c*. The large-capacity stacker 200*a* can receive a sheet printed in the printing apparatus 100 via the sheet conveyance path from the printing apparatus 100. The large-capacity stacker 200*a* includes a wagon on which a large amount of sheets can be successively stacked one on top of another when the sheets are received from the printing apparatus 100. An example configuration of the large-capacity stacker 200*a* is described below in detail.

The gluing bookbinding machine 200*b* can receive a sheet printed in the printing apparatus 100 via the sheet conveyance path from the large-capacity stacker 200*a*. The gluing bookbinding machine 200*b* performs gluing bookbinding processing on the received sheet. The saddle stitch binding machine 200*c* can receive a sheet printed in the printing apparatus 100 via the sheet conveyance path from the gluing bookbinding machine 200*b*. The saddle stitch binding machine 200*c* performs saddle stitch binding processing on the received sheet.

Each of the above-described sheet processing apparatuses is equipped with a unique sheet stacking unit. An operator can take out the sheets from the sheet stacking units of respective sheet processing apparatuses after the sheet processing has been completed in the respective sheet processing apparatuses. Further, the connection order of the above-described sheet processing apparatuses can be arbitrarily changed as far as they are connected serially via the sheet conveyance path.

Figure 4:
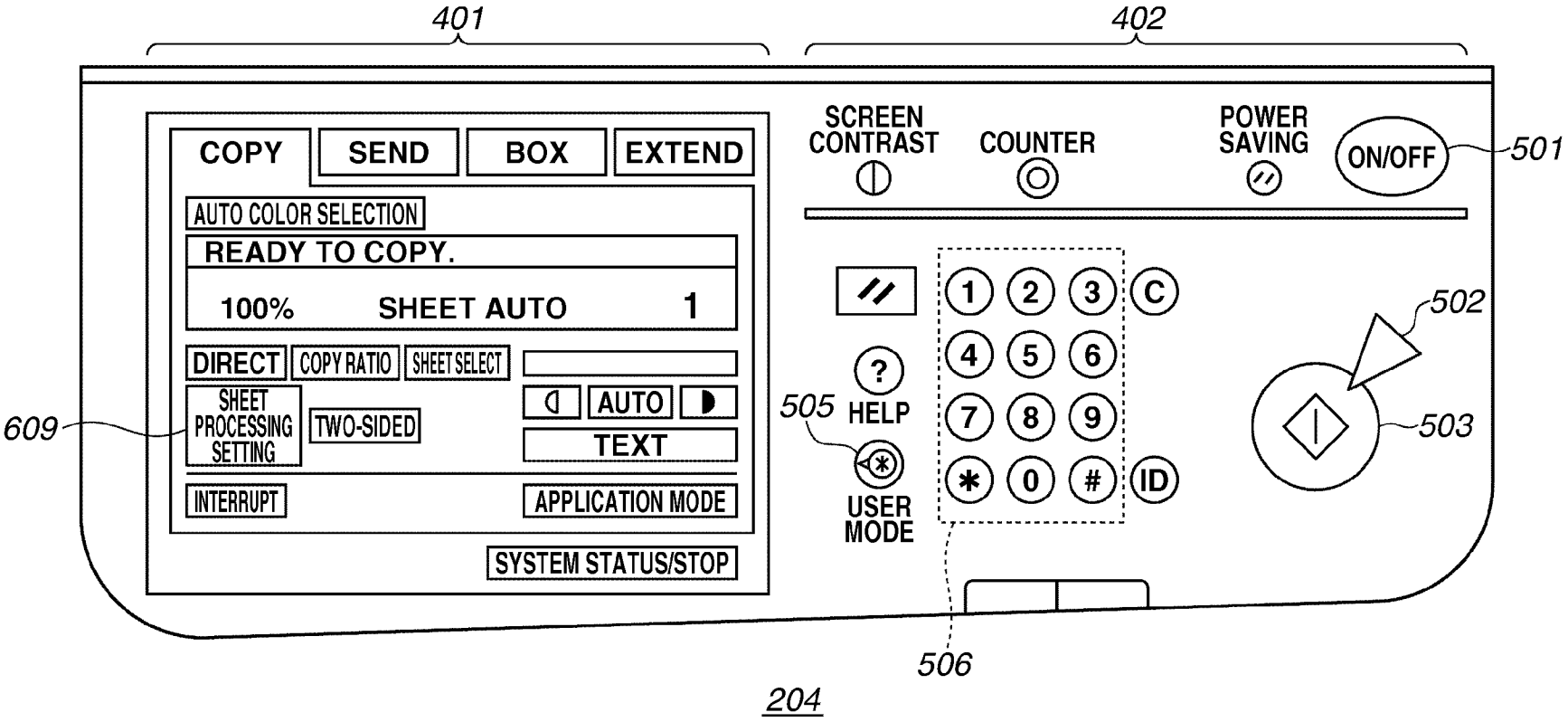
FIG. 4 illustrates an example of an operation unit included in the printing system.

FIG. 4 illustrates the operation unit 204 included in the printing system 1000 illustrated in FIG. 1. In FIG. 4, the operation unit 204 includes a key input unit 402 that is constituted by a plurality of hard keys and a touch panel unit 401 that is constituted by a plurality of soft keys (display keys). The operation unit 204 can accept various instructions that are entered by a user via the key input unit 402 or the touch panel unit 401.

First, the key input unit 402 is described in detail. The key input unit 402 includes a power source key 501, a stop key 502, and a start key 503. The power source key 501 can be operated to turn on or off a power source of the operation unit 204.

The start key 503 is a key that accepts a user's instruction when the user instructs the printing apparatus 100 to start job processing (e.g., copy and data transmission). The stop key 502 is a key that accepts a user's instruction when the user instructs the printing apparatus 100 to interrupt the accepted job processing. A numeric keypad 506 includes numerical keys that accept a user's instruction when the user sets a number of copies of a copy job to be printed or inputs various numerical values. A user mode key 505 is a key that enables individual users to display a unique system setting screen dedicated to each user on the touch panel unit 401.

Next, the touch panel unit 401 illustrated in FIG. 4 is described below in detail. The touch panel unit 401 includes a liquid crystal display (LCD) and a layer of transparent electrodes disposed on the LCD. The touch panel unit 401 can display a user interface that enables each operator to perform various settings for individual jobs.

For example, if a "COPY" tab on the touch panel unit 401 is pressed by an operator, the control unit 205 causes the touch panel unit 401 to display an operation screen (e.g., a screen displayed on the touch panel unit 401 illustrated in FIG. 4) that relates to a copy function of the printing apparatus 100. The operator can perform various settings for a job while manipulating a two-sided key, a copy ratio key, and a sheet processing setting key 609 dedicated to post-processing settings which are displayed on the copy operation screen illustrated in FIG. 4.

If a "SEND" tab is pressed by a user, the control unit 205 causes the touch panel unit 401 to display an operation screen that relates to a data transmission (i.e., Send) function of the printing apparatus 100. The Send function to be realized by the printing apparatus 100 includes transmission of facsimiles and E-mails. If a "BOX" tab is pressed by a user, the control unit 205 causes the touch panel unit 401 to display an operation screen that relates to a box function of the printing apparatus 100.

The box function is a data management function that enables individual users to store user data in independent storage areas designated beforehand for respective users in the HDD 209. The box function provides a plurality of data storage box (hereinafter, simply referred to as "box") that can be used by individual users. According to the box function, each user can instruct the printing system 1000 to perform designated processing on a selected image in the box.

For example, the control unit 205 responds to an instruction input from a user via the operation unit 204 and stores image data read by the scanner unit 201 into a box selected by the user. Further, the control unit 205 can store job data received from the PC 103 via the external I/F unit 202 into a box designated via the user interface unit of the PC 103. Furthermore, the control unit 205 causes the printer unit 203 to print job data stored in a box according to a user instruction input via the operation unit 204 so as to realize a print pattern requested by the user. The control unit 205 can transmit job data stored in a box to an external information processing apparatus such as the PC 103. When the sheet processing setting key 609 is pressed, a screen that enables a user to perform settings for the sheet processing to be performed by the sheet processing apparatus 200 is displayed.

Figure 5:
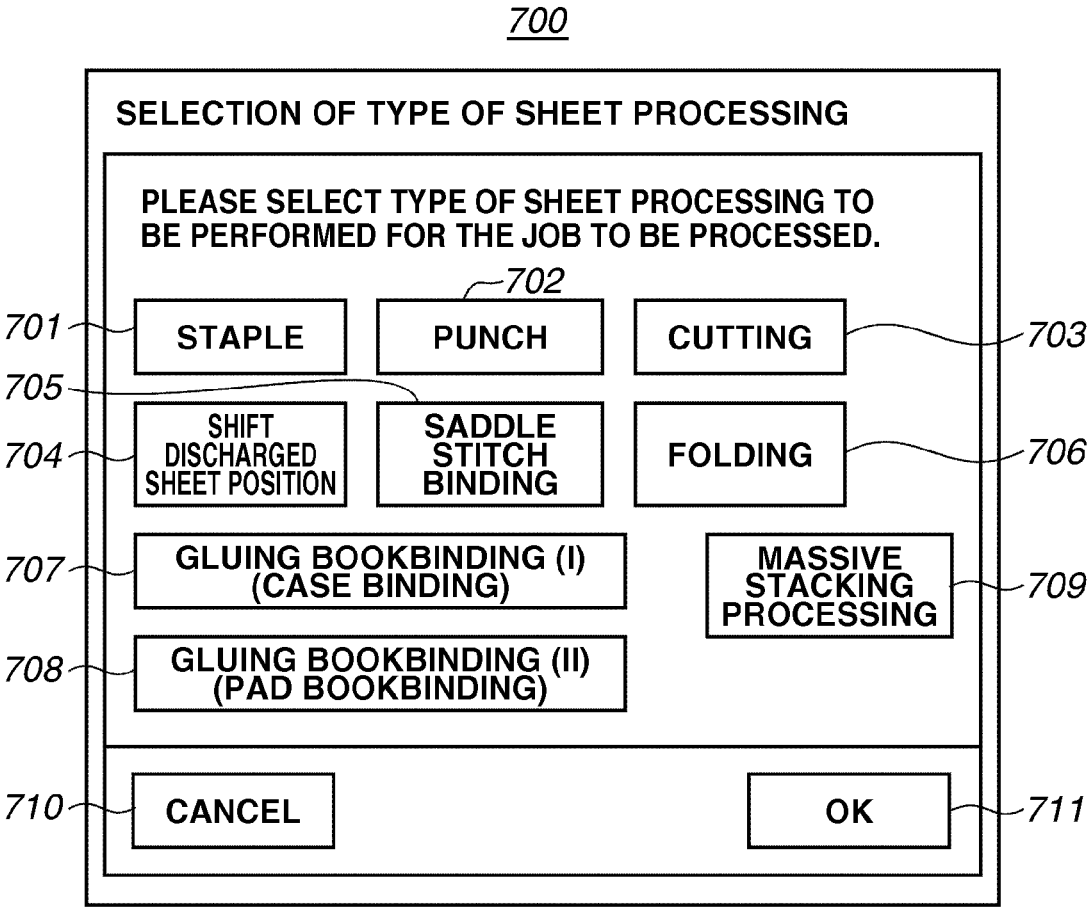
FIG. 5 illustrates an example display of a screen that enables a user to perform settings for sheet processing.

FIG. 5 illustrates an example display of a screen that enables a user to perform settings for sheet processing which can be displayed on the touch panel unit 401 illustrated in FIG. 4. The screen illustrated in FIG. 5 is a setting screen that is configured to enable a user to select a type of sheet processing to be performed by the sheet processing apparatus 200 included in the printing system 1000. The control unit 205 receives a setting result of the sheet processing to be executed for a job (i.e., a processing object) via the screen illustrated in FIG. 5. The control unit 205 executes control to realize processing for causing the sheet processing apparatus 200 to perform sheet processing according to the settings.

For example, if a staple key 701 is operated to set "Staple" as sheet processing to be performed, the control unit 205 controls the saddle stitch binding machine 200*c* to perform staple processing on printed sheets. If a punch key 702 is operated to set "Punch" as sheet processing to be performed, the control unit 205 controls the saddle stitch binding machine 200*c* to perform punch processing on printed sheets. Further, if a cutting key 703 is operated to set "Cutting" as sheet processing to be performed, the control unit 205 controls the saddle stitch binding machine 200*c* to perform cutting processing on printed sheets with its cutter. Further, if a shift key 704 is operated to set "Shift Discharged Sheet Position" as sheet processing to be performed, the control unit 205 controls the saddle stitch binding machine 200*c* to perform shift processing on printed sheets received from the printing apparatus 100 so as to shift the position of the sheets to be discharged from the saddle stitch binding machine 200*c*, thereby performing control to realize processing for shifting a locating position of the sheet discharged immediately before.

Further, if a saddle stitch binding key 705 is operated to set "Saddle Stitch Binding" as sheet processing to be performed, the control unit 205 controls the saddle stitch binding machine 200*c* to perform saddle stitch binding processing on printed sheets received from the printing apparatus 100. Further, if a folding key 706 is operated to set "Folding" as sheet processing to be performed, the control unit 205 controls the saddle stitch binding machine 200*c* to perform folding processing on printed sheets received from the printing apparatus 100. If a gluing bookbinding (I) key 707 is operated to set "Gluing Bookbinding (I) (Case Binding)" as sheet processing to be performed, the control unit 205 controls the saddle stitch binding machine 200*c* to perform case binding processing on printed sheets received from the printing apparatus 100.

If a gluing bookbinding (II) key 708 is operated to set "Gluing Bookbinding (II) (Pad Bookbinding)" as sheet processing to be performed, the control unit 205 controls the gluing bookbinding machine 200*b* to perform pad bookbinding processing on printed sheets received from the printing apparatus 100. If a massive stacking processing key 709 is operated to set "Massive Stacking Processing" as sheet processing to be performed, the control unit 205 controls the large-capacity stacker 200*a* to perform massive stacking processing. If any other key is operated by a user, the control unit 205 controls the printing system 1000 to perform predetermined processing corresponding to the key operated by the user. The screen illustrated in FIG. 5 further includes a cancel key 710 and an OK key 711.

Figure 6:
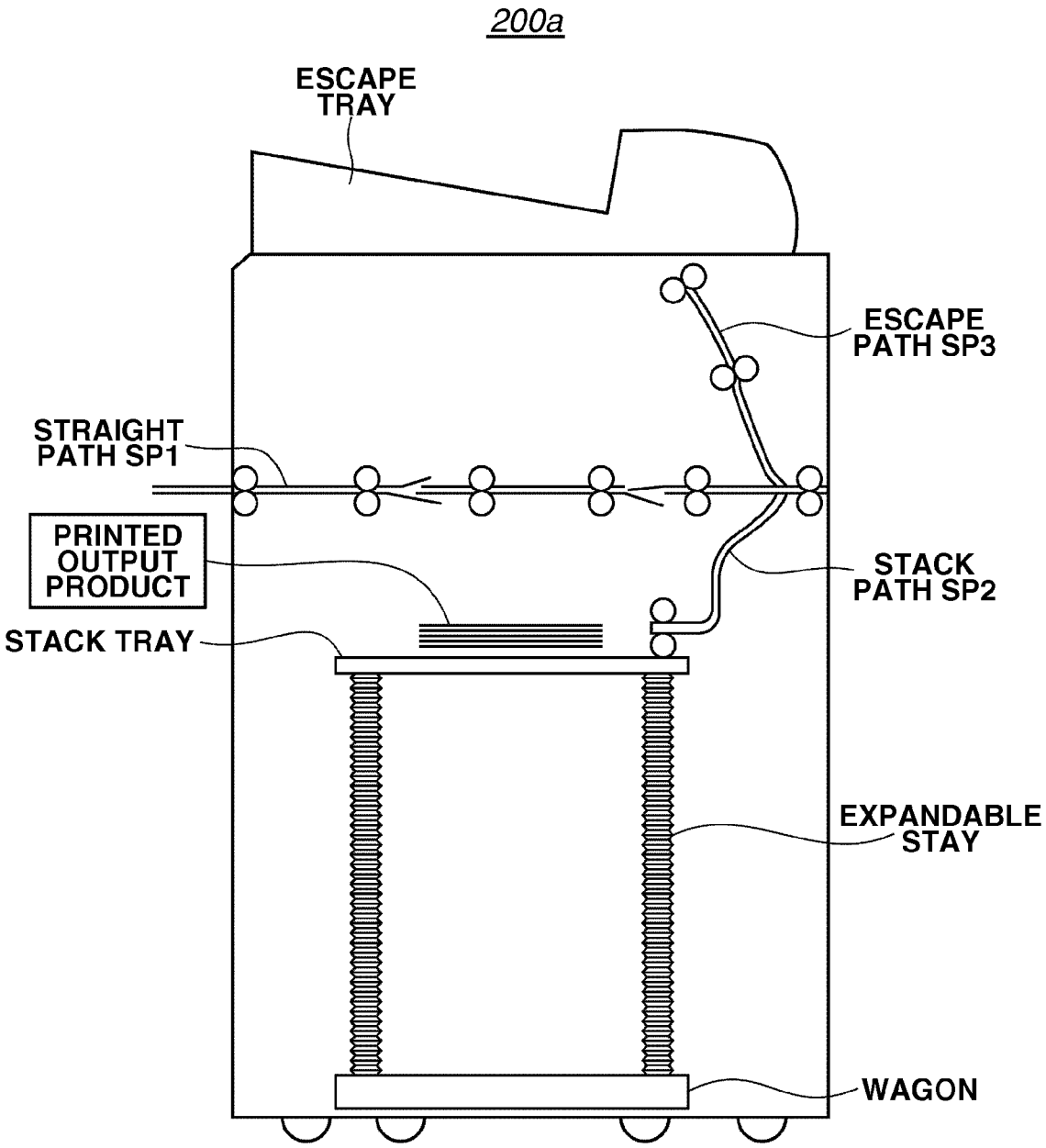
FIG. 6 illustrates an example configuration of a large-capacity stacker.

FIG. 6 illustrates an example configuration of the large-capacity stacker 200*a* illustrated in FIG. 3. As illustrated in FIG. 6, the large-capacity stacker 200*a* includes three sheet conveyance paths that can serve as conveyance paths for conveying sheets received from the printing apparatus 100.

More specifically, the sheet conveyance paths provided in the large-capacity stacker 200*a* are a straight path SP1, a stack path PS2, and an escape path PS3. The straight path PS1 is a sheet conveyance path configured to send a sheet to the following sheet processing apparatus in a case where the massive stacking processing is not perform on this sheet and therefore the sheet is not discharged to a stack tray of the large-capacity stacker 200*a*. The escape path PS3 is a sheet conveyance path configured to output a sheet to an escape tray, for example, in a case where there is no sheet processing apparatus that follows the large-capacity stacker 200*a* or in a case where checking work (i.e., a proof print) of an output product is performed. The stack path SP2 is a sheet conveyance path configured to discharge a sheet to the stack tray.

These sheet conveyance paths are equipped with a plurality of sheet detection sensors which can detect a sheet being conveyed in the large-capacity stacker 200*a* and can generate a sensor signal representing sheet detection information (e.g., status or jam of the sheet). Each sensor transmits the obtained sheet detection information to the control unit 205 via a signal line. Each sensor and the control unit 205 can perform data communication with each other via this signal line. The control unit 205 detects a conveyance status or jam status of a sheet in the large-capacity stacker 200*a* based on the sheet detection information transmitted from the respective sensors.

The large-capacity stacker 200*a* is controlled by the control unit 205 in the following manner, for example, if the massive stacking processing key 709 illustrated in FIG. 5 is operated to set the massive stacking processing to be performed by the large-capacity stacker 200*a*. The control unit 205 performs control to realize processing for discharging the sheets printed by the printer unit 203 to the stack tray.

The stack tray illustrated in FIG. 6 is a stacking unit mounted on an expandable stay. A shock absorber is attached to a joint portion of the stack tray. The control unit 205 controls the large-capacity stacker 200*a* to perform processing for stacking print-completed sheets of a job (i.e., a processing object) on the stack tray. The lower part of the expandable stay is the wagon to which a handle (not illustrated) is attachable to carry the stacked output to another off-line finisher.

The large-capacity stacker 200*a* has a front door (not illustrated). When the front door is closed, the control unit 205 moves the expandable stay to an upper position where stacking of the stack output can be surely performed. Further, when the front door is opened by an operator, the control unit 205 moves the stack tray to a lower position.

Figure 7:
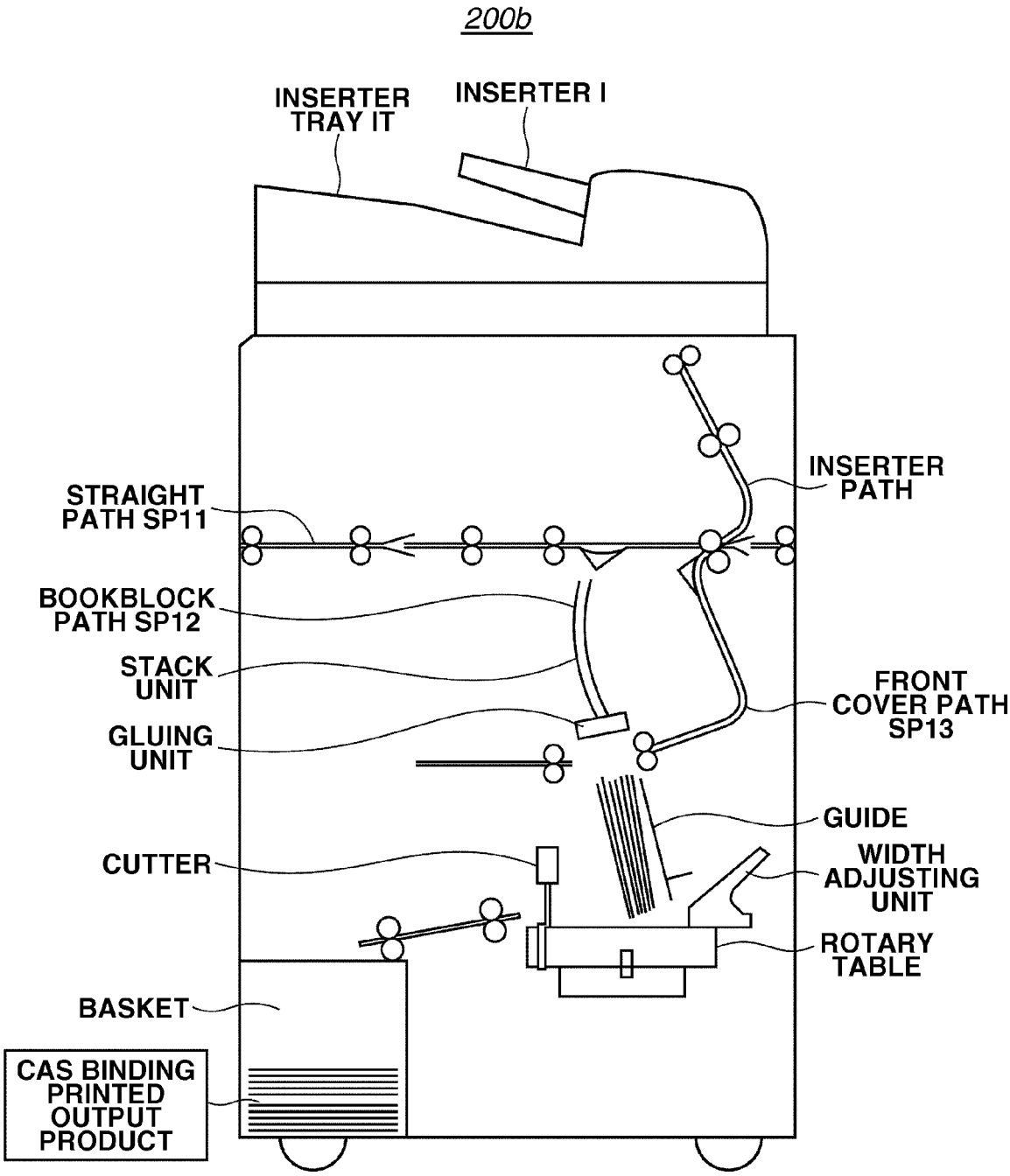
FIG. 7 illustrates an example configuration of a gluing bookbinding machine.

FIG. 7 illustrates an example configuration of the gluing bookbinding machine 200*b* illustrated in FIG. 3. The gluing bookbinding machine 200*b* illustrated in FIG. 7 includes a straight path SP11, a bookblock path SP12, and a front cover path SP13, as sheet conveyance paths that are continuous from the printing apparatus 100. These sheet conveyance paths are equipped with a plurality of sheet detection sensors which can detect a sheet being conveyed in the gluing bookbinding machine 200*b* and can generate a sensor signal representing sheet detection information (e.g., status or jam of the sheet). Each sheet detection sensor sends the obtained sheet detection information to the control unit 205. The straight path (i.e., a through path) SP11 is a sheet conveyance path that is configured to convey each sheet, if a job to be perform for the sheet does not include sheet gluing bookbinding processing to be performed by the gluing bookbinding machine 200*b*, to a downstream apparatus (i.e., the saddle stitch binding machine 200*c*).

Both the bookblock path SP12 and the front cover path SP13 are sheet conveyance paths to be used when the product to be generated is a case binding print product. For example, as example case binding print processing, the printer unit 203 performs processing for printing print data that constitute a book body. The printed sheets obtained in the above-described print processing are used as a book body portion of an output product (i.e., a bundle of case binding print product). The sheet bundle of the book body portion (i.e., the sheets on which the print data that correspond to the book body (book contents) portion are printed) produced by the case binding is referred to as "bookblock" in the present exemplary embodiment.

The case binding processing further includes processing for covering the bookblock with a piece of sheet that serves as a front cover. The control unit 205 performs control to realize processing for conveying a sheet to be used as the front cover via the front cover path SP13 and conveying the above-described "bookblock" (i.e., the sheets printed by the printer unit 203) to the bookblock path SP12.

According to the above-described configuration, for example, if the control unit 205 receives an instruction to perform the case binding, for example, via the gluing bookbinding (I) key 707 illustrated in FIG. 5, the control unit 205 controls the apparatus in the following manner. For example, the control unit 205 performs control to successively receive printed sheets from the printer unit 203 and store the received sheets in a stack unit via the bookblock path SP12 illustrated in FIG. 7. Then, the control unit 205 performs control to convey a front cover sheet to be used to wrap the bookblock via the front cover path SP13 after storage of all pages (i.e., sheets corresponding to the bookblock of a book or a booklet) in the stack unit is completed.

In the above-described case binding processing, an inserter tray IT illustrated in FIG. 7 can supply a sheet that can be used as a front cover sheet. In this case, for example, a user can use a preprint sheet on which front cover data is already printed. Alternatively, a sheet on which a front cover image is already printed by the printing apparatus 100 can be used as a front cover sheet. As described above, the gluing bookbinding machine 200*b* can select, as a front cover sheet, a sheet to be inserted from the inserter tray IT or a sheet to be conveyed from the printing apparatus 100.

Then, the gluing bookbinding machine 200*b* temporarily stops the front cover sheet at a portion beneath the stack unit. An inserter I is configured to convey, in addition to the above-described front cover sheet, a preprint sheet (i.e., a print completed slip sheet) and a tab-attached sheet (i.e., an index sheet) to be inserted in the book body. In the present exemplary embodiment, preprint sheets, index sheets, tab-attached sheets, and front covers are classified into a second sheet. The inserter tray IT can function as the second sheet feeding unit according to the present exemplary embodiment which can feed the above-described second sheet. The gluing bookbinding machine 200*b* including the second sheet feeding unit is an optional unit that can be detachably connected to the image forming apparatus.

The gluing bookbinding machine 200*b* performs gluing processing on a bookblock that includes a plurality of print completed sheets as all pages of the book body in a state where the stacking of the bookblock at the stack unit is completed. For example, a gluing unit of the gluing bookbinding machine 200*b* applies a predetermined amount of glue to a spine portion (i.e., a lower part) of the bookblock. In a state where the glue is sufficiently applied to the spine portion, the spine portion is aligned along the central portion of a front cover sheet and integrally wrapped together. When the bookblock is assembled with the front cover sheet, the bookblock is pressed downward. The bookblock integrated with the front cover moves along the guide and falls down to a rotary table, and then lies on the upper surface of the rotary table.

A width adjusting unit adjusts the position of the assembly composed of the bookblock and the front cover that is placed on the rotary table. Then, a cutter cuts a front edge portion of the assembly composed of the bookblock and the front cover. Next, the rotary table rotates 90 degrees. Then, the width adjusting unit performs positioning again. Then, the cutter cuts a top edge portion of the assembly of the bookblock and the front cover. Further, the rotary table rotates 180 degrees. The width adjusting unit performs positioning and the cutter cuts a bottom edge portion of the assembly of the bookblock and the front cover. Then, the width adjusting unit pushes the cutting completed assembly of the bookblock and the front cover into a basket. After the glue is sufficiently dried in the basket, the case binding bundle can be finally taken out of the basket.

Figure 8:
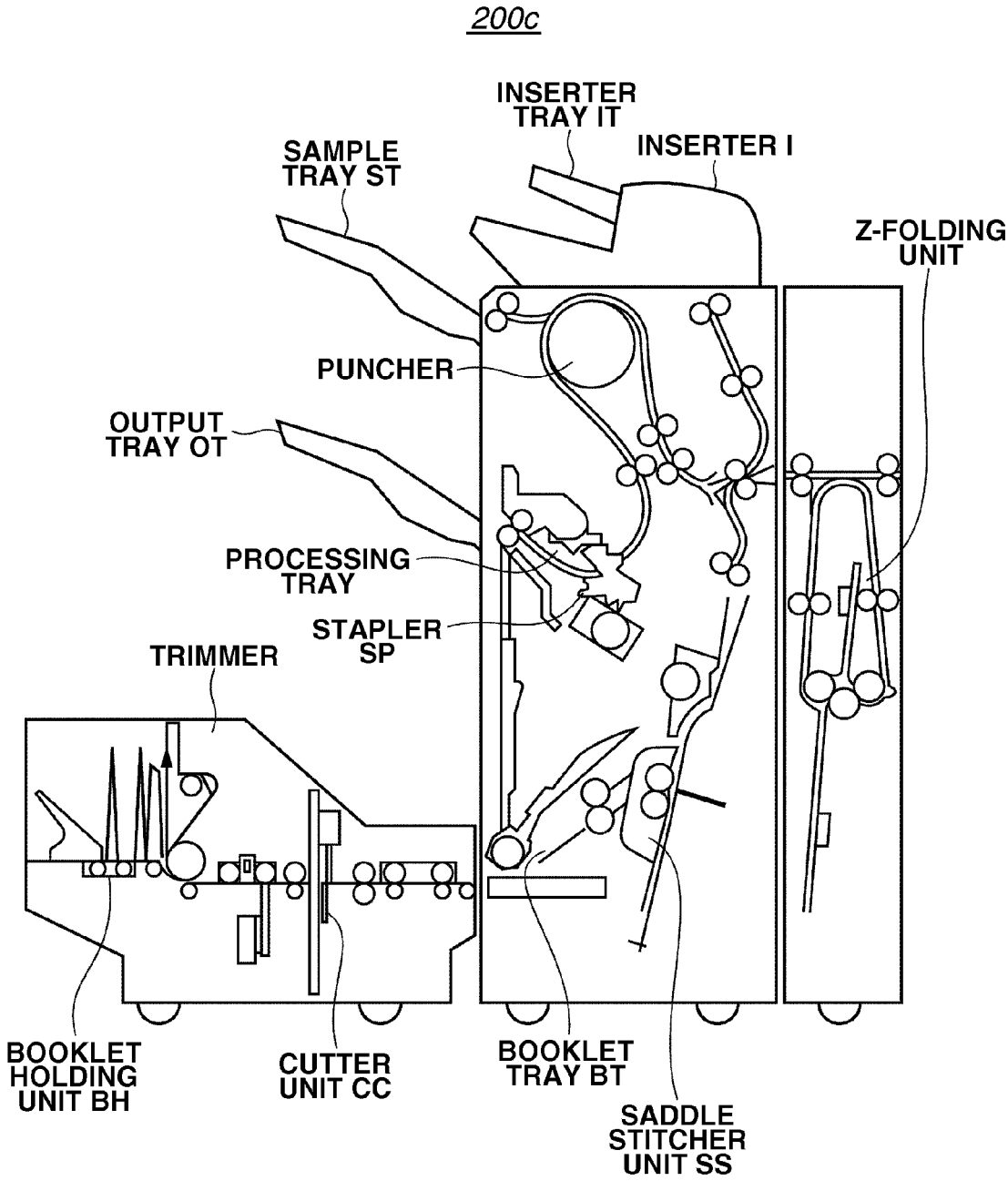
FIG. 8 illustrates an example configuration of a saddle stitch binding machine.

FIG. 8 illustrates an example configuration of the saddle stitch binding machine 200*c* illustrated in FIG. 3. The saddle stitch binding machine 200*c* illustrated in FIG. 8 performs staple processing, cutting processing, punch processing, and folding processing on sheets that have been conveyed from the printing apparatus 100. The saddle stitch binding machine 200*c* includes a sheet conveyance path equipped with a plurality of sheet detection sensors that can obtain sheet detection information (e.g., status or jam of the sheet). Each sensor sends the obtained sheet detection information to the control unit 205 via a signal line. Each sensor and the control unit 205 can perform data communication with each other via this signal line. The control unit 205 detects a conveyance status or jam status of a sheet existing in the saddle stitch binding machine 200*c* based on the sheet detection information obtained from respective sensors. If any other sheet processing apparatus (e.g., the gluing bookbinding machine 200*b*) is present between the saddle stitch binding machine 200*c* and the printing apparatus 100, the signal line provided in the intervening sheet processing apparatus (e.g., the gluing bookbinding machine 200*b*) can be used to transmit sensor information of the saddle stitch binding machine 200*c* to the control unit 205.

The saddle stitch binding machine 200*c*, as illustrated in FIG. 8, includes a sample tray ST, an output tray OT, and a booklet tray BT. The control unit 205 performs a switching control to realize processing for selecting a unit to be used according to the type of a job or the number of discharged recording sheets. When the staple processing is performed, the saddle stitch binding machine 200*c* performs control to realize processing for conveying sheets received from the gluing bookbinding machine 200*b* to the output tray OT. More specifically, before discharging the sheets to the output tray OT, the saddle stitch binding machine 200*c* successively stores the sheets on a processing tray. A stapler SP binds the sheets on the processing tray. Subsequently, the stapled sheets are discharged to the output tray OT. The saddle stitch binding machine 200*c* further includes a Z-folding unit that can fold a sheet into a Z-folded shape and a puncher that can open two (or three) through-holes for filing. The above-described devices provided in the saddle stitch binding machine 200*c* can perform sheet processing according to print settings. Each processed sheet is conveyed via an internal path of the saddle stitch binding machine 200*c* and finally discharged to a designated sheet discharge tray (e.g., the output tray OT, the sample tray ST, or the like).

The saddle stitch binding machine 200*c* further includes a saddle stitcher unit SS that can perform saddle stitch binding processing. The saddle stitch binding processing to be performed by the saddle stitcher unit SS includes holding a plurality of sheets, binding a bundle of stacked sheets at two central portions, and half-folding the sheet bundle at a midpoint thereof with a roller. The sheet bundle completed by the saddle stitcher unit SS is discharged, as a bookbinding completed product (e.g., as a pamphlet), to the booklet tray BT.

The inserter I can supply a sheet set on the inserter tray IT to the output tray OT, or the sample tray SP, or the saddle stitcher unit SS. In other words, the inserter I can insert a sheet between any two sheets that are successively sent from the printing apparatus 100 to the saddle stitch binding machine 200*c*.

The saddle stitch binding machine 200*c* further includes a cutting device. Each bookbinding completed product is discharged from the saddle stitcher unit SS to the booklet tray BT and is then conveyed into the cutting device. In this case, rollers convey the bookbinding completed product along the conveyance direction by a predetermined length. A cutter unit CC cuts an edge of the bookbinding completed product by an amount corresponding to the predetermined length. Then, each bookbinding completed product cut by the cutter unit CC is stored in a booklet holding unit BH. In the present exemplary embodiment, the inserter I functions as the second sheet feeding unit. The control unit 205 performs control to realize processing for discharging an insertion sheet to a second sheet stacking unit, as described below. The sample tray ST functions as the second sheet stacking unit.

Figure 9:
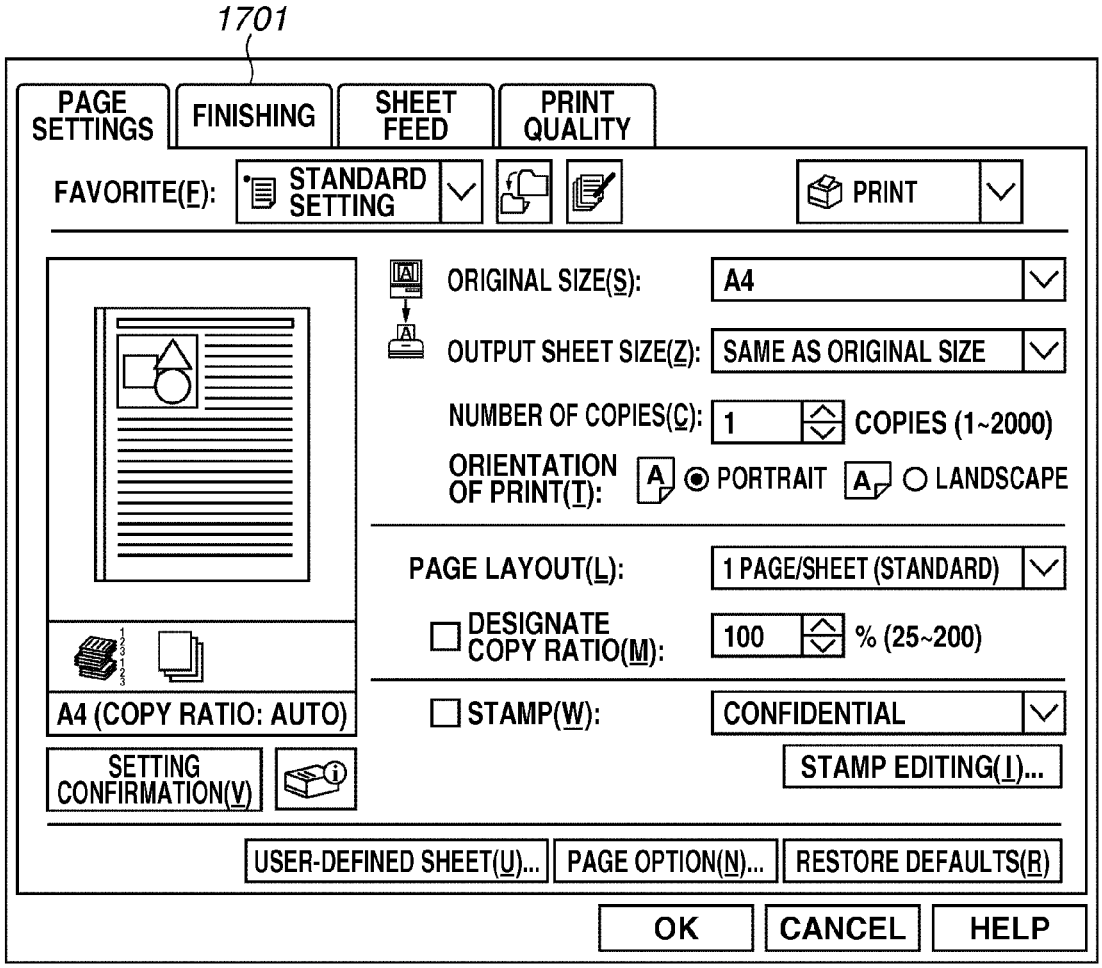
FIG. 9 illustrates an example of a user interface (UI) that can be displayed on a display unit of a personal computer (PC).
Figure 10:
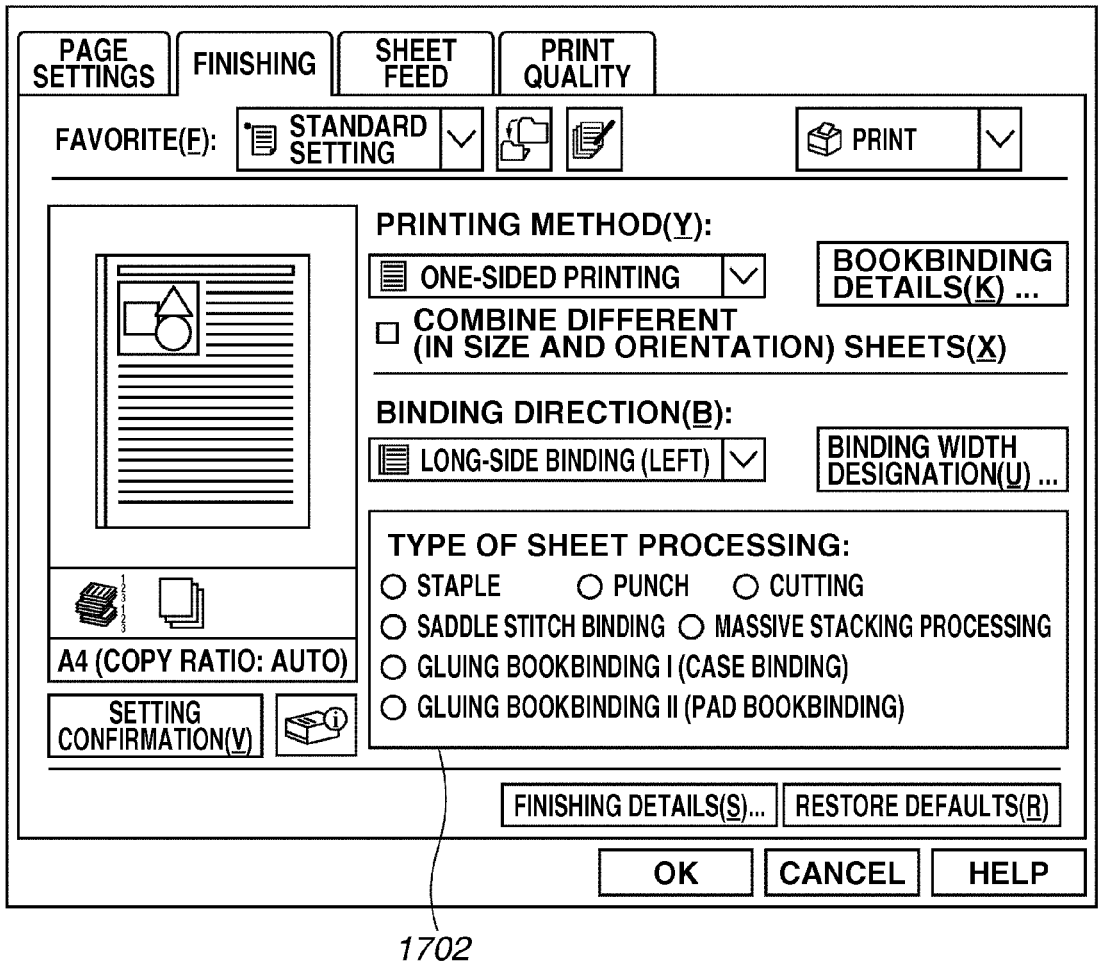
FIG. 10 illustrates an example of the UI that can be displayed on the display unit of the PC.

FIGS. 9 and 10 illustrate examples of the user interface which can be displayed on the display unit of respective PCs 103 and 104 illustrated in FIG. 1. Hereinafter, an example screen that can be displayed on the display unit of the PC 103 is described below with reference to FIG. 9. In the present exemplary embodiment, a printer driver installed on the PC 103 enables a user to perform print settings for image data generated by the PC 103. The PC 104 can display a similar screen on its display unit to enable a user to perform print settings.

It is now assumed that a user performs a mouse operation to select a finishing tab 1701 on the display screen illustrated in FIG. 9 which enables the user to perform page settings. In this case, the PC 103 switches the screen display from the print settings screen to a finishing setting screen illustrated in FIG. 10. The PC 103 enables the user to select a type of processing to be executed by the in-line type sheet processing apparatus 200 included in the printing system 1000 via the finishing setting screen illustrated in FIG. 10.

The user can designate sheet processing to be performed by selecting any one of a plurality of setting item check buttons 1702. Then, the user clicks on an OK key that is displayed on the finishing setting screen illustrated in FIG. 10 in a state where the above-described selection of the sheet processing is completed. After the above-described print settings are completed, the control unit of the PC 103 stores the determined print settings in the RAM of the PC 103. Then, if the user instructs to transmit the image data to the printing system 1000, the control unit of the PC 103 associates the image data with the print settings and transmits the associated data as one job to the printing system 1000. In the present exemplary embodiment, the printer driver generates each job. The printing system 1000 receives the job transmitted from the PC 103 via the external I/F unit 202 and performs a printing operation based on the print settings.

Figure 11:
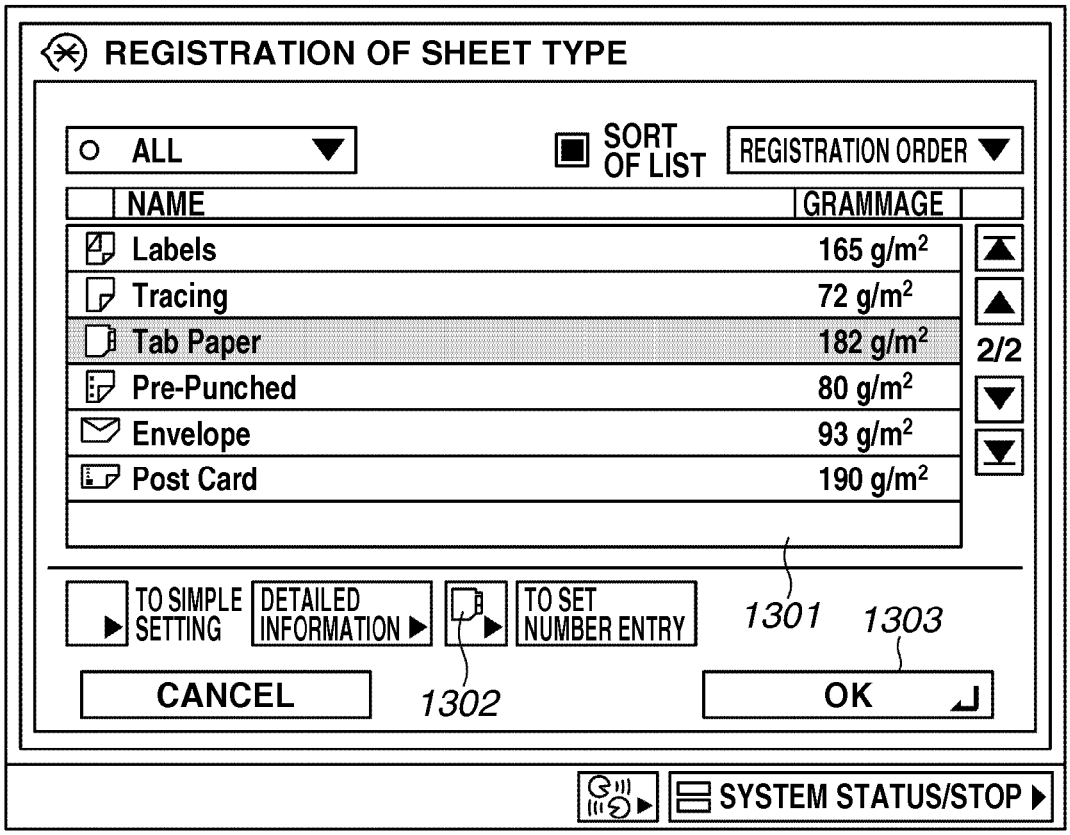
FIG. 11 illustrates an example of a UI that can be displayed on a touch panel unit.
Figure 12:
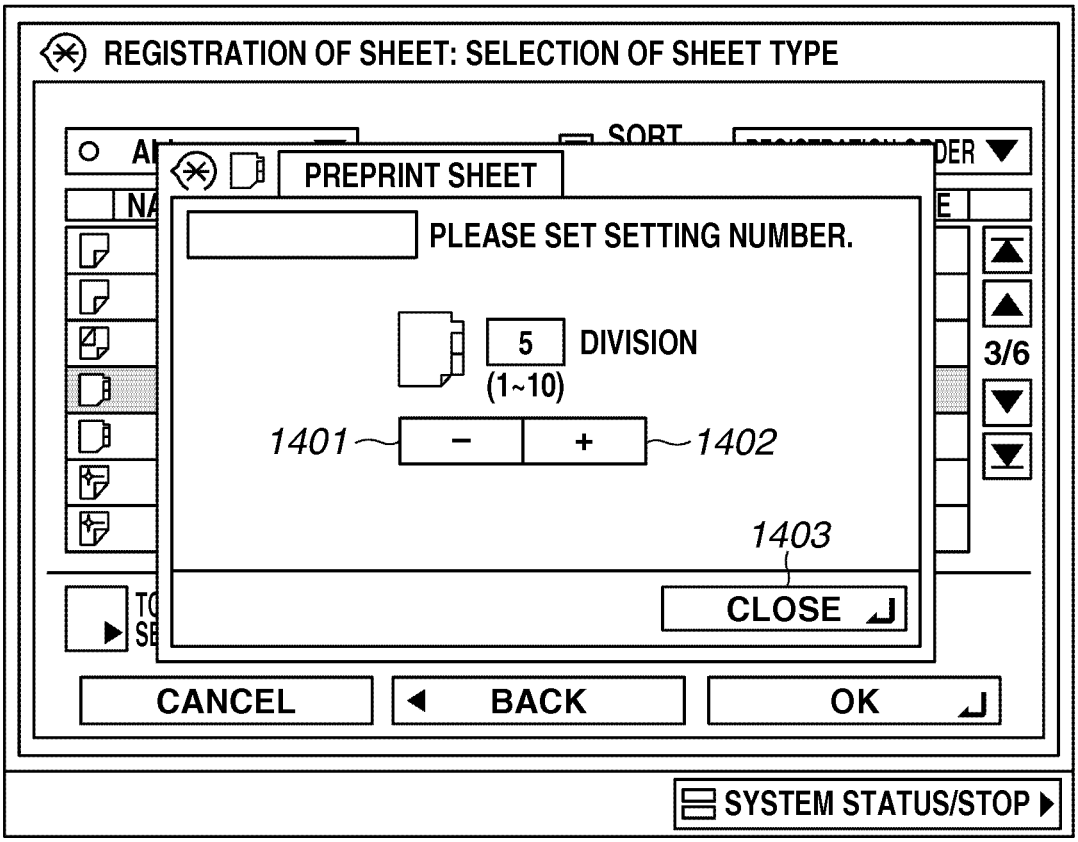
FIG. 12 illustrates an example of the UI that can be displayed on the touch panel unit.

FIGS. 11 and 12 illustrate examples of the user interface which can be displayed on the touch panel unit 401 illustrated in FIG. 4. The examples illustrated in FIGS. 11 and 12 are example screens that enable a user to register a sheet type. Hereinafter, an example method for registering a sheet type of sheets that are set in the sheet feeding cassette is described in detail with reference to the screen illustrated in FIG. 11.

For example, a user sets tab-attached sheets in the sheet feeding cassette 317, and causes the operation unit 204 to display the screen illustrated in FIG. 11 on the touch panel unit 401. Then, the user selects, on the screen illustrated in FIG. 11, a sheet type of the sheets set in the sheet feeding cassette 317 and presses a button 1303. When the button 1303 is pressed, the control unit 205 stores the sheet type selected by the user, as information indicating the sheet type of the sheets set in the sheet feeding cassette 317, in the HDD 209.

If "Tab Paper" is selected on the screen illustrated in FIG. 11, a button 1302 is displayed as a selectable button. If the user selects the button 1302 to input a set number (i.e., the number of sheets that are separated by an insertion sheet), the control unit 205 displays a set number input screen illustrated in FIG. 12 on the touch panel unit 401 of the operation unit 204. Thus, in a case where a set of a plurality of first sheets is discharged, the user can set the set number of the second sheets (i.e., the number of a plurality of second sheets that are designated as a set) to be fed from, for example, the inserter I that serves as the second sheet feeding unit.

The set number input screen enables a user to input a total number of preprint sheets per set. The set number can be changed by operating a button 1401 or a button 1402. If the user presses a close button 1403, the control unit 205 closes the set number input screen and displays the sheet type registration screen again. If the button 1303 is pressed, the control unit 205 stores the set number set by the user in the HDD 209.

The above-described sheet type registration method is applied to the sheet feeding cassette 317. A similar sheet type registration method can be applied to each of the sheet feeding cassette 318 and the inserter tray IT. The user can set information indicating an insertion sheet (i.e., a sheet feeding stage) to be used, beforehand, using the user interfaces illustrated in FIGS. 11 and 12. The information set by the user is stored in the HDD 209. Accordingly, when the control unit 205 performs the following control, the control unit 205 can obtain the information indicating the insertion sheet (i.e., the sheet feeding stage) from the HDD 209.

Next, an example sequence of a characteristic control that can be performed by the printing system 1000 according to the present exemplary embodiment is described below.

Figure 13:
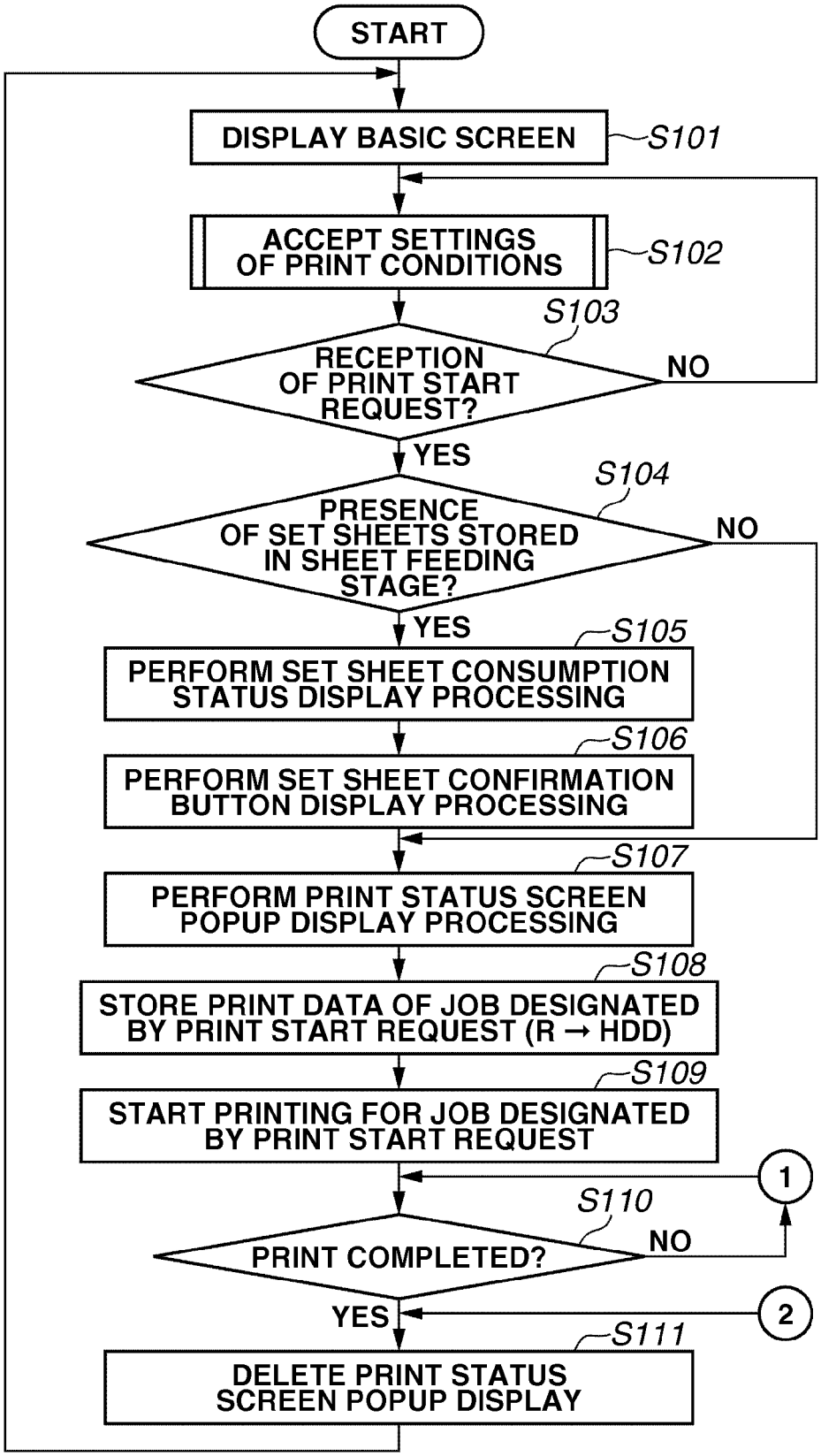
FIG. 13 is a flowchart illustrating an example of a print processing procedure that can be performed by an image forming apparatus according to an exemplary embodiment of the present invention.
Figure 14:
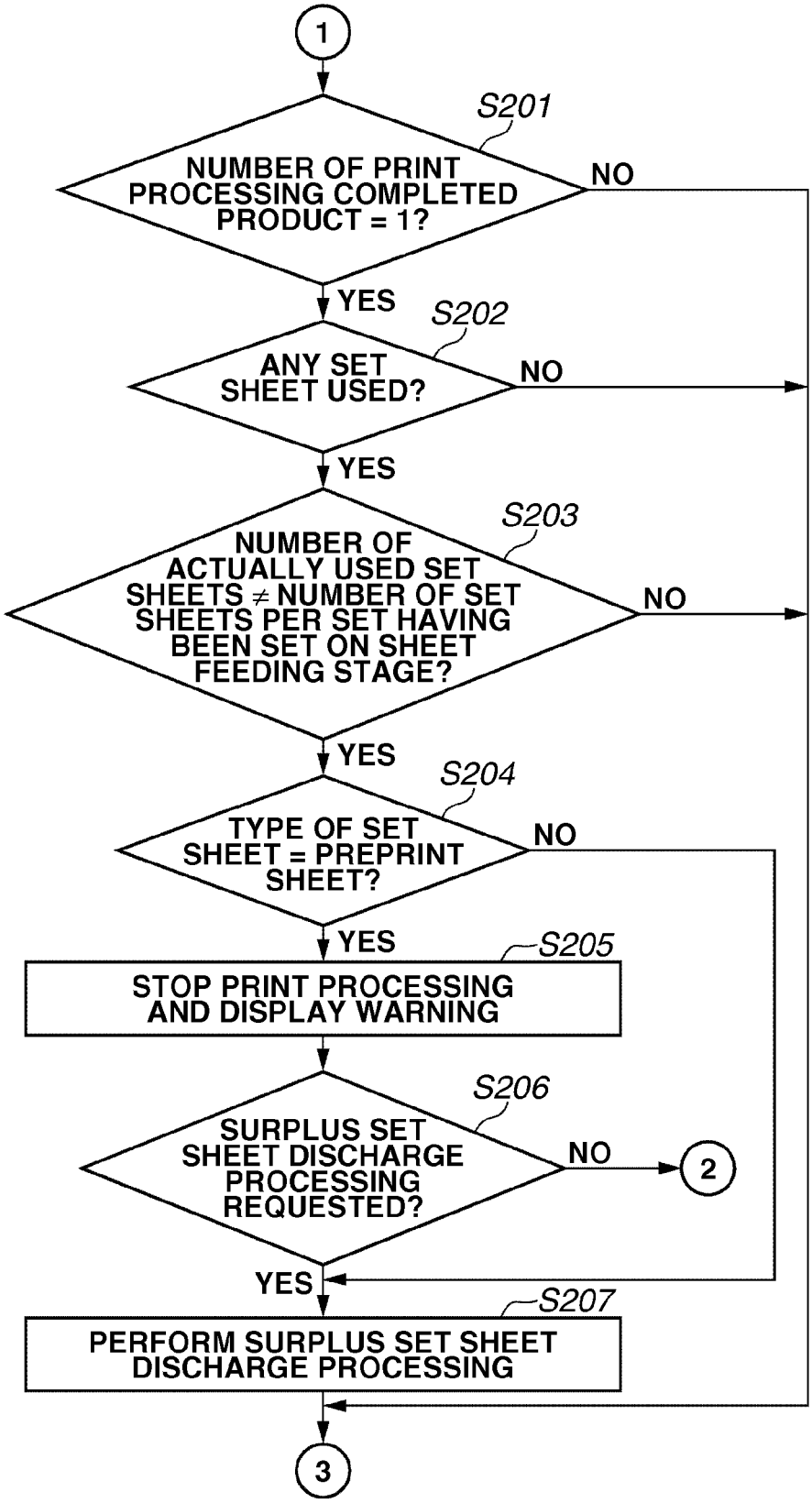
FIG. 14 is a flowchart illustrating the print processing procedure that can be performed by the image forming apparatus.

FIGS. 13 and 14 are flowcharts illustrating an example procedure of print processing to be performed by the image forming apparatus according to the present exemplary embodiment. In the present exemplary embodiment, the control unit 205 performs a sheet feeding control during image forming processing in which the first sheets and the second sheets are used. In FIGS. 13 and 14, steps S101 to S111 and steps S201 to S207 are example steps. Further, to realize each step, the control unit 205 illustrated in FIG. 2 executes the control program loaded into the RAM 208 from the ROM 207.

Figure 15:
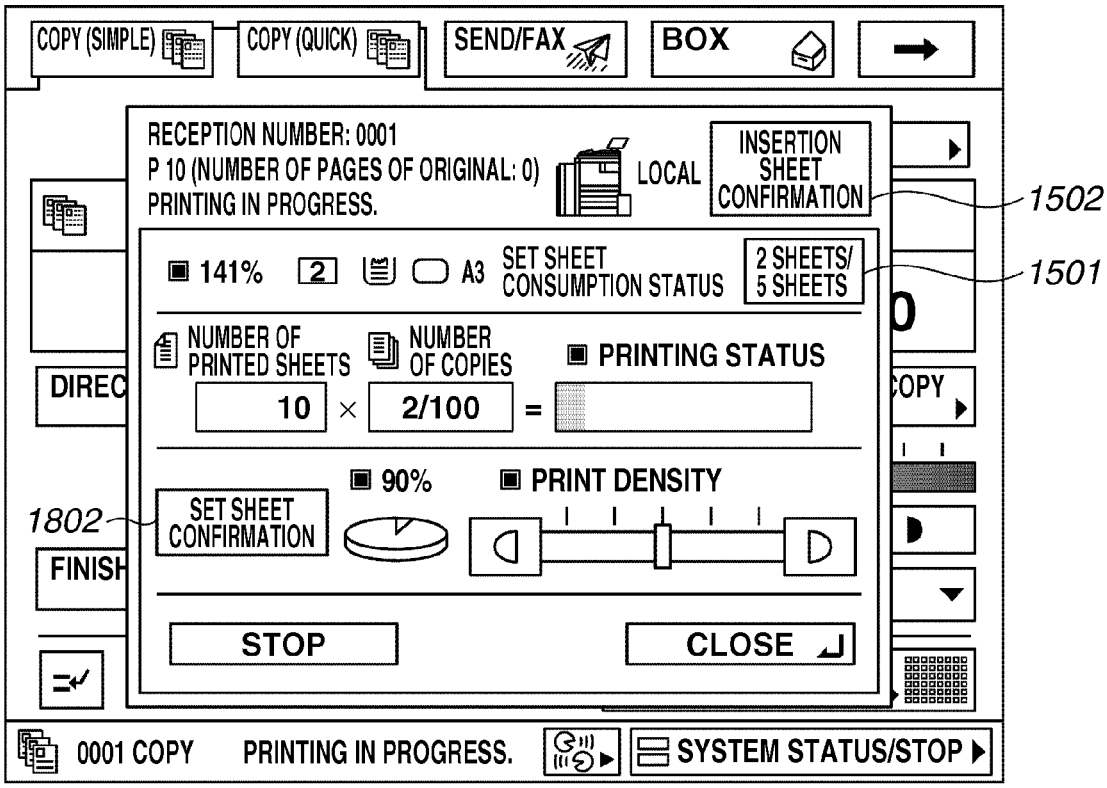
FIG. 15 illustrates an example of the UI that can be displayed on the touch panel unit.
Figure 16:
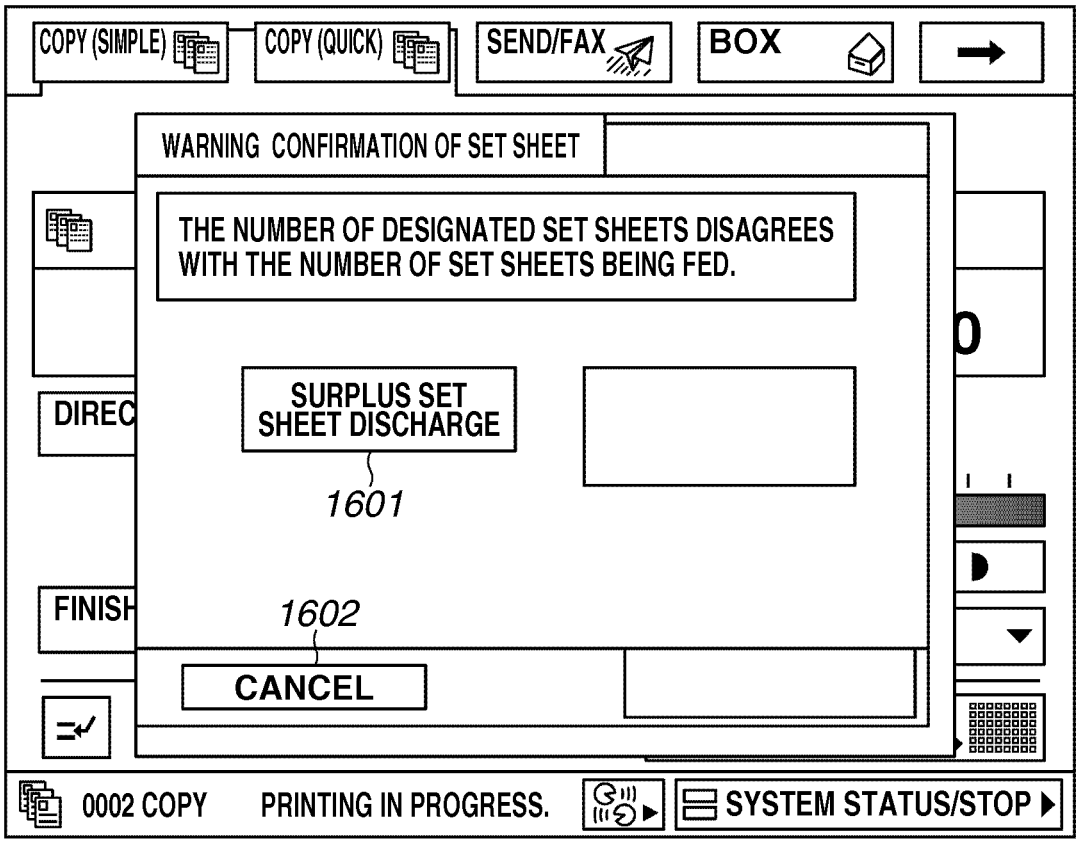
FIG. 16 illustrates an example of the UI that can be displayed on the touch panel unit.

FIGS. 15 and 16 illustrate examples of the user interface which can be displayed on the touch panel unit 401 illustrated in FIG. 4.

Further, an example control flow according to the present exemplary embodiment includes causing the printer unit 203 to print image data read by the scanner unit 201 based on print settings received from a user via the operation unit 204, and causing the gluing bookbinding machine 200*b* to perform case binding processing. However, the present invention is not limited to the printing operation of the image data read by the scanner unit 201. For example, the present invention can be applied to a printing operation of image data to be transmitted from the PC 103 or the PC 104.

In step S101, the control unit 205 displays a basic screen (see FIG. 4) on the operation unit 204. In step S102, the control unit 205 accepts print settings set by a user. In the present exemplary embodiment, an operator inserts a set of a plurality of preprint sheets to generate the above-described case binding output product. First, the user places the preprint sheets on the inserter tray IT of the inserter provided in the gluing bookbinding machine 200*b*.

Next, in step S103, the control unit 205 determines whether a print start request by the start key 503 has been received via the operation unit 204. The control unit 205 repeats the processing of step S103 until reception of the print start request is confirmed. Then, if the control unit 205 determines that the print start request by the start key 503 has been received (YES in step S103), the processing proceeds to step S104.

Then, in step S104, the control unit 205 determines whether usage of a set of a plurality of insertion sheets has been set at the reception timing of the print start request. If the control unit 205 determines that the usage of the set of the insertion sheets has been set (YES in step S104), the processing proceeds to step S105. If the control unit 205 determines that the usage of the set of the insertion sheets has not been set (NO in step S104), the processing proceeds to step S107.

In the present exemplary embodiment, the user can set information designating a sheet feeding stage that stores the insertion sheets, using the user interfaces illustrated in FIGS. 11 and 12. The information set by the user is stored in the HDD 209. Further, of the set of a plurality of insertion sheets, the user can input the number of insertion sheets that are used to obtain a single print product (in step S102). In this case, the user can designate a page number of the print product to which the insertion sheet is to be inserted. In the above-described exemplary embodiment, the user determines the number of insertion sheets and the insertion position. However, the present invention is not limited to the above-described exemplary embodiment. For example, the control unit 205 can count the number of insertion sheets based on information of the insertion sheet that is included in a job.

Next, in step S105, the control unit 205 acquires, from the HDD 209, the number of insertion sheets per set (i.e., the number of a set of a plurality of insertion sheets) that is presently set and the number of insertion sheets that are used to obtain a single print product. Further, the control unit 205 performs processing for displaying a status of consumed sheets per set with respect to the insertion sheets on the touch panel unit 401 (see a set sheet consumption status 1501 illustrated in FIG. 15).

Next, in step S106, the control unit 205 performs processing for displaying an insertion sheet confirmation button (see a insertion sheet confirmation button 1502 illustrated in FIG. 15). In step S107, the control unit 205 displays a print status screen illustrated in FIG. 15 on the touch panel unit 401 of the operation unit 204.

In the present exemplary embodiment, if in step S104 the control unit 205 determines that the usage of insertion sheets has been set, the control unit 205 displays the set sheet consumption status 1501 on the print status screen with respect to the sheet feeding tray that supplies the insertion sheet. Further, the control unit 205 displays the insertion sheet confirmation button. The above-described displays enable a check of the present status in use of one set of a plurality of insertion sheets. Therefore, the operator can easily check presence of any disorder with respect to the insertion sheets by visually checking the insertion sheets placed on the inserter I even when a print product is currently output.

Next, in step S108, the control unit 205 causes the scanner unit 201 to read print data of a job designated by the print start request and stores the read data in the HDD 209. Then, the processing proceeds to step S109. In step S109, the control unit 205 causes the printer unit 203 to start processing for printing the print data of the job designated by the print start request.

Then, in step S110, the control unit 205 determines whether the print processing has been completed. If the control unit 205 determines that the print processing has been completed (YES in step S110), the processing proceeds to step S111. In step S111, the control unit 205 deletes the print status screen illustrated in FIG. 15 and switches the screen display to the standard screen. Then, the processing returns to step S101.

On the other hand, if the control unit 205 determines that the print processing is not yet completed (NO in step S110), the processing proceeds to step S201 illustrated in FIG. 14.

In step S201, the control unit 205 determines whether print processing for a first product of the job has been completed. If the control unit 205 determines that the print processing for the first product of the job is not yet completed (NO in step S201), the processing proceeds to step S109 illustrated in FIG. 13. If the control unit 205 determines that the print processing for the first product of the job has been completed (YES in step S201), the processing proceeds to step S202.

Then, in step S202, the control unit 205 determines whether any insertion sheet has been used in the print processing for the first product of the job. If the control unit 205 determines that no insertion sheet has been used in the print processing (NO in step S202), the processing proceeds to step S401 illustrated in FIG. 17. If the control unit 205 determines that the insertion sheet has been used in the print processing (YES in step S202), the processing proceeds to step S203.

Then, in step S203, the control unit 205 determines whether the number of the insertion sheets that have been used for the first product of the job is equal to the number of one set of insertion sheets set on the sheet feeding tray. In the present exemplary embodiment, the control unit 205 is configured to momentarily count the number of insertion sheets having been used during the execution of the job. The count information (i.e., the number of counted sheets) is stored in the memory (e.g., the HDD 209). If the control unit 205 determines that the number of the insertion sheets actually used agrees with the number of N (N is an integer) sets of insertion sheets set on the sheet feeding tray (NO in step S203), the processing proceeds to step S401 illustrated in FIG. 17. If the control unit 205 determines that the number of the insertion sheets actually used disagrees with the number of the insertion sheets set on the sheet feeding tray (YES in step S203), the processing proceeds to step S204.

Then, in step S204, the control unit 205 determines whether the type of the insertion sheets set on the sheet feeding tray is "preprint sheet." If the control unit 205 determines that the sheet type of the insertion sheets is not the "preprint sheet", for example, in a case where tab eared index sheets are set on the sheet feeding tray (NO in step S204), the processing proceeds to step S207. If the control unit 205 determines that the sheet type of the insertion sheets is the "preprint sheet" (YES in step S204), the processing proceeds to step S205. In the context of the present description, the "preprint sheet" is referred to as a sheet on which an image and a page number are printed beforehand. The user can set, beforehand, the preprint sheet for the sheet feeding cassette via the screen illustrated in FIG. 11. Thus, the control unit 205 can identify the type of the insertion sheets set on sheet feeding tray as the preprint sheet.

Then, in step S205, the control unit 205 temporarily stops the print processing and causes the operation unit 204 to display a warning screen illustrated in FIG. 16 because the number of insertion sheets per set having been used for the received job disagrees with the number of insertion sheets per set which are set on the sheet feeding tray. As a result, the control unit 205 suspends the image forming operation to be performed for the next and following sets. The reason why the image forming operation is suspended in this case is because insertion of one set of preprint sheets for one print product is not yet completed. In other words, the control unit 205 cannot resume the image forming operation unless the insertion of one set of preprint sheets for one print product is completed. On the other hand, in a case where the insertion sheets are tab eared index sheets, it is unnecessary to insert all of the index sheets per set. Therefore, the control unit 205 does not interrupt the image forming operation.

According to the example warning screen illustrated in FIG. 16, the user is allowed to determine whether to perform processing for discharging surplus insertion sheets. If the control unit 205 determines that a surplus insertion sheet discharge button 1601 (i.e., a button to be pressed to automatically start processing for discharging the surplus insertion sheets) has been pressed by the user, the processing proceeds to step S207.

On the other hand, if the control unit 205 determines that a cancel button 1602 has been pressed by the user on the display screen illustrated in FIG. 16, the processing proceeds to step S111. In step S111, the control unit 205 stops the print processing. After the processing of step S207 relating to the surplus insertion sheets is terminated, the processing proceeds to step S401 illustrated in FIG. 17.

In step S401, the control unit 205 determines whether the user has input an insertion sheet confirmation request (i.e., an output confirmation request) by operating the insertion sheet confirmation button 1502 illustrated in FIG. 15. If the control unit 205 determines that the insertion sheet confirmation button 1502 is not pressed by the user (NO in step S401), the processing returns to step S110 illustrated in FIG. 13. If the control unit 205 determines that the insertion sheet confirmation button 1502 has been pressed (YES in step S401), the processing proceeds to step S402. The above-described insertion sheet confirmation button 1502 is included in the screen illustrated in FIG. 15. The user can press the insertion sheet confirmation button 1502 when the screen illustrated in FIG. 15 is displayed on the touch panel unit 401 of the operation unit 204. When the insertion sheet confirmation button 1502 is pressed by the user, the control unit 205 can store information indicating that the user pressed the insertion sheet confirmation button 1502. In step S401, the control unit 205 can check the presence of the insertion sheet confirmation request based on the stored information.

Figure 18:
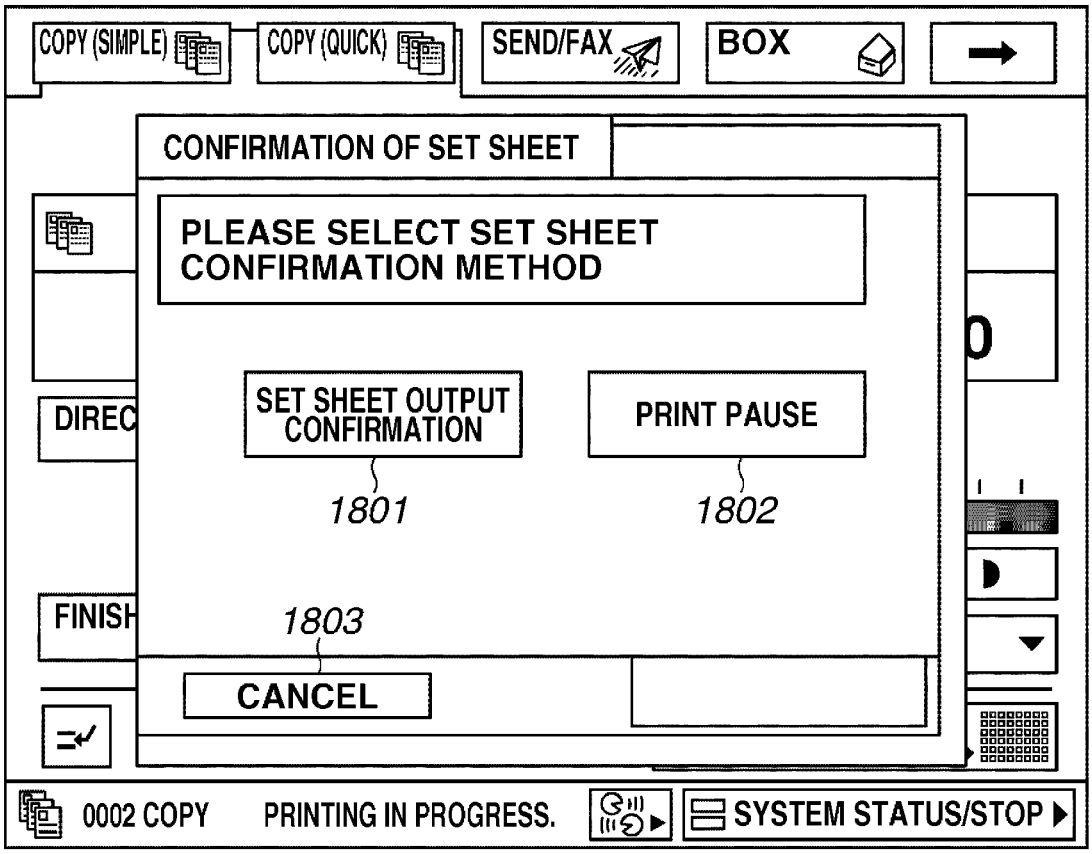
FIG. 18 illustrates an example of the UI that can be displayed on the touch panel unit.

Then, in step S402, the control unit 205 displays an operation screen illustrated in FIG. 18 on the operation unit 204. The operation screen illustrated in FIG. 18 enables the user to select an insertion sheet confirmation method. Then, in step S403, the control unit 205 determines whether an insertion sheet output confirmation button 1801 has been pressed by the user.

If the control unit 205 determines that the insertion sheet output confirmation button 1801 has been pressed by the user on the operation screen illustrated in FIG. 18 (YES instep S403), the processing proceeds to step S404. Then, in step S404, the control unit 205 performs control to realize processing for discharging one set of a plurality of insertion sheets, which has been used in the print processing, from the corresponding sheet feeding tray. In this case, under the control of the control unit 205, discharge of sheets to an output destination other than the presently used sheet discharge destination is performed for operator confirmation use. Thus, the user can check any disorder of the insertion sheets.

Figure 17:
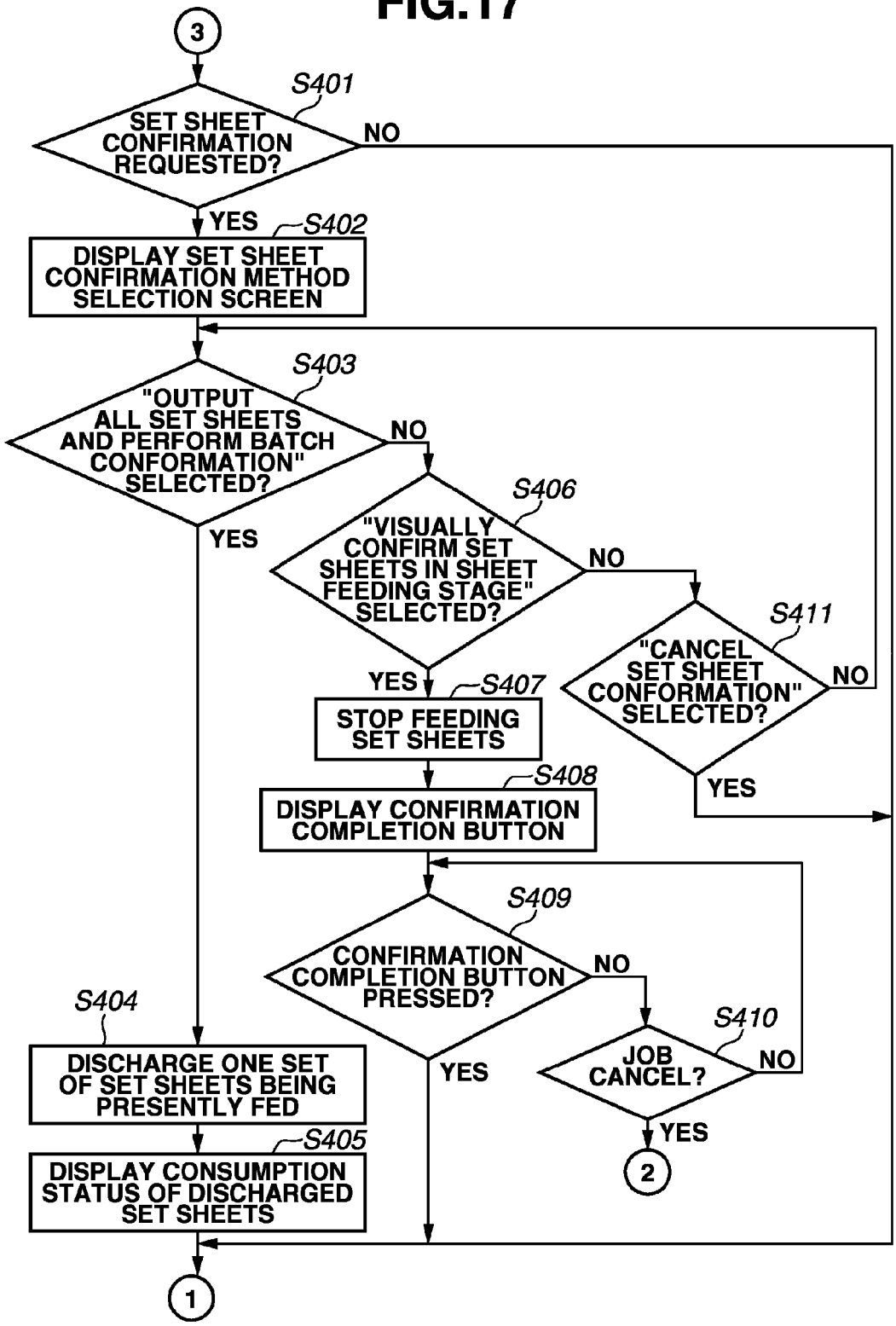
FIG. 17 is a flowchart illustrating an example a print processing procedure that can be performed by the image forming apparatus.

Then, in step S405, the control unit 205 displays a consumption status of discharged insertion sheets on the operation unit 204 and terminates the processing of the routine illustrated in FIG. 17. Although the insertion sheet consumption status is already displayed on the screen illustrated in FIG. 15, another screen can be used for the display to be performed in step S405. Thus, even in a case where one set of a plurality of insertion sheets is placed on a sheet feeding tray that is invisible, the user can easily confirm an output status of the insertion sheets presently output.

Further, performing the sheet insertion processing on a set-by-set basis is useful to efficiently output the insertion sheets without causing any disorder or any interruption. The productivity can be maintained at a higher level.

On the other hand, if the control unit 205 determines that the insertion sheet output confirmation button 1801 is not pressed by the user (NO in step S403), the processing proceeds to step S406. Then, in step S406, the control unit 205 determines whether the user has pressed a print pause button 1802 on the operation screen illustrated in FIG. 18 that enables the user to select the insertion sheet confirmation method. If the control unit 205 determines that the print pause button 1802 has been pressed by the user (YES in step S406), the processing proceeds to step S407. In step S407, the control unit 205 stops feeding the insertion sheets.

In the present exemplary embodiment, the control unit 205 continuously performs the sheet feeding operation, other than the insertion sheets, and the print processing. Therefore, the productivity can be maintained at a higher level.

Figure 19:
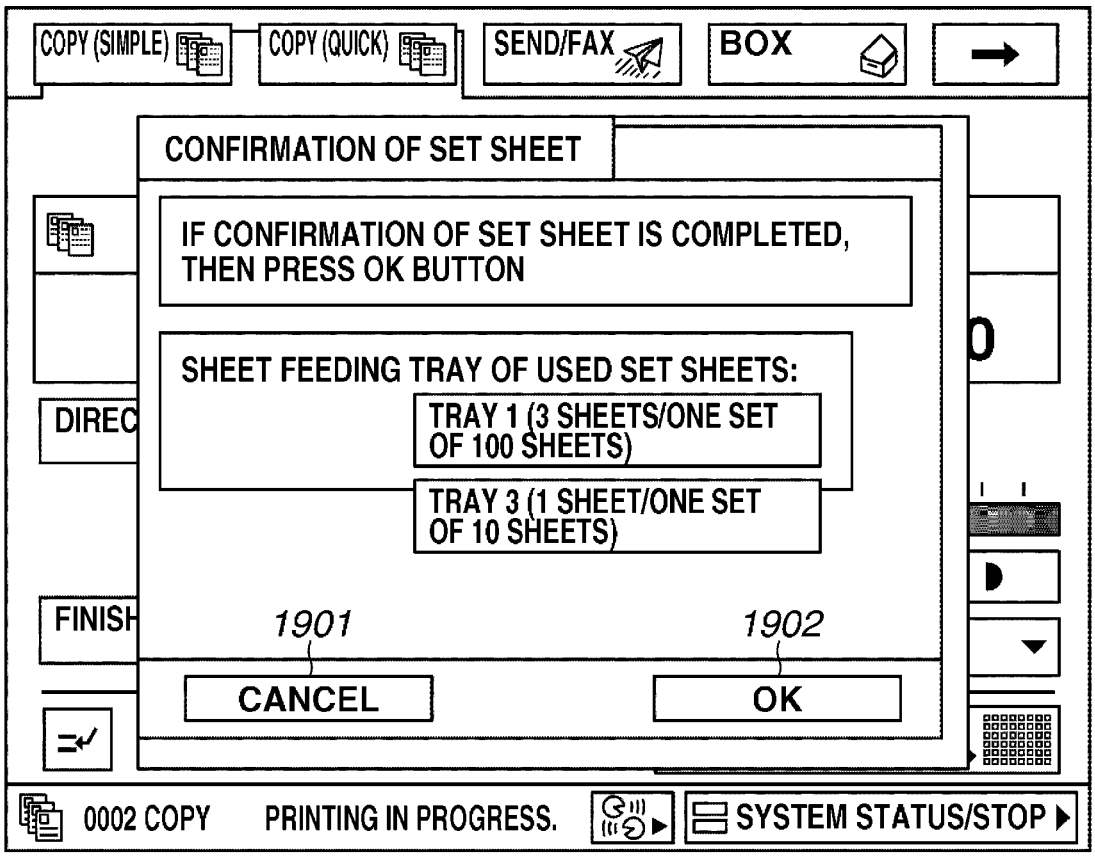
FIG. 19 illustrates an example of the UI that can be displayed on the touch panel unit.

Then, in step S408, the control unit 205 displays an operation screen illustrated in FIG. 19, which enables the user to select termination of the above-described insertion sheet confirmation operation, on the touch panel unit 401 of the operation unit 204. Further, the control unit 205 displays sheet feeding tray information relating to the used insertion sheets. Thus, the user can remove sheets from the displayed sheet feeding tray, and confirm whether the order of the insertion sheet that remains in the designated sheet feeding tray agrees with the displayed consumption status.

Next, in step S409, the control unit 205 determines whether a confirmation termination button 1902 is pressed by the user in a state where the screen illustrated in FIG. 19 is displayed. If the control unit 205 determines that the confirmation termination button 1902 is not selected by the user (NO in step S409), the processing proceeds to step S410.

Then, in step S410, the control unit 205 determines whether a job cancel button 1901 has been selected by the user after the screen illustrated in FIG. 19 is displayed. More specifically, in a case where any abnormality is recognized as a confirmation result with respect to the order of insertion sheets, the user presses the job cancel button 1901. Therefore, the determination result in step S410 becomes YES and the processing of the control unit 205 proceeds to step S111

On the other hand, if the control unit 205 determines that the confirmation termination button 1902 has been pressed by the user (YES in step S409), the control unit 205 performs the processing from step S110.

Further, if the control unit 205 determines that the job cancel button 1901 is not pressed (NO in step S410), the processing returns to step S409. Further, if the control unit 205 determines that the user has not pressed the print pause button 1802 (NO in step S406), the processing proceeds to step S411.

Then, in step S411, the control unit 205 determines whether the user has pressed an insertion sheet confirmation cancel button 1803. If the control unit 205 determines that the insertion sheet confirmation cancel button 1803 has been pressed by the user (YES in step S411), the control unit 205 terminates the processing of the routine illustrated in FIG. 17. If the control unit 205 determines that the insertion sheet confirmation cancel button 1803 is not pressed (NO in step S411), the processing returns to step S403.

According to the above-described present exemplary embodiment, in a case where the number of insertion sheets per set is large, the productivity can be maintained at a higher level without suspending other print processing. Further, in a case where the number of insertion sheets per set is small or in a case where confirmation of numerous sheet feeding trays is applicable, the productivity can be maintained at a higher level by selecting the above-described insertion sheet discharge processing, without stopping the print processing.

Thus, the present exemplary embodiment can prevent pre-print sheets set on sheet feeding tray by another user from being erroneously used. A user who has input a print instruction can surely obtain a print product. Further, user's labor can be minimized if the above-described processing is performed at the completion timing of the first product of the requested job.

Further, according to the present exemplary embodiment, in a case where the automatic surplus insertion sheet discharge processing request is received based on a user's operation, the processing proceeds to step S207. Then, in step S207, the control unit 205 discharges a set of surplus insertion sheets to another sheet discharge destination other than the sheet discharge destination to which the sheets are presently output. Therefore, the control unit 205 can start the print processing for the second and following products without any trouble. Subsequently, the processing proceeds to step S110 illustrated in FIG. 13.

Constructing the above-described printing environment enables a user to easily check any disorder of the insertion sheets during the sheet processing while maintaining the productivity at a higher level even in a case where one set of a plurality of insertion sheets is used. More specifically, if the number of already used sheets disagrees with the number of sheets set beforehand as the number of sheets of one bundle of insertion sheets, the control unit 205 determines that the insertion sheets are in the above-described surplus condition and discharges surplus sheets that corresponds to a difference in the number of sheets.

The present exemplary embodiment is not limited to the above-described simple comparison in number of sheets. For example, in a case where the number of sheets set beforehand is less than the number of sheets that has been counted, the control unit 205 obtains a difference between (the number of sheets set beforehand)×(N: integer) and the number of sheets counted. For example, in a case where index sheets are set as "sheet bundle" in the sheet feeding stage and the index sheets used for one print product is "sheet", the control unit 205 calculates (the number of sheets set:)×(N: 2)−(the number of sheets count:) as the number of sheets to be discharged.

The above-described exemplary embodiment can be applied to a case where insertion sheets to be inserted are set on the inserter tray IT (i.e., the tray that is visible) of the of the gluing bookbinding machine 200*b*. Further, the above-described exemplary embodiment can be applied to a case where insertion sheets to be inserted are set on another sheet feeding tray (i.e., the first sheet feeding unit) that is invisible.

As described above, the present exemplary embodiment does not suspend other print processing in a case where the number of insertion sheets per set is large. Therefore, the present exemplary embodiment can maintain the productivity at a higher level. Further, the present exemplary embodiment selects the above-described insertion sheet discharge processing without stopping the print processing in a case where the number of insertion sheets per set is small or in a case where confirmation of numerous sheet feeding trays is applicable. Therefore, the present exemplary embodiment can maintain the productivity at a higher level.

The above-described exemplary embodiments are characteristic controls that can realize the present invention. However, the present invention is not limited to the above-described exemplary embodiments and can be modified in various ways without departing from the gist of the present invention. An example modification of the present invention includes an organic combination of the above-described exemplary embodiments. In this respect, the present invention does not intend to exclude other embodiments that are not discussed in this description. For example, in the present exemplary embodiments, the control unit 205 of the printing apparatus 100 chiefly executes the above-described various controls. However, an external controller provided separately from the printing apparatus 100 can be configured to execute at least a part or entire of the above-described various controls.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-091821 filed Apr. 6, 2009, which is hereby incorporated by reference herein in its entirety.

What is claimed is:

1. An apparatus which executes a job for outputting first sheets fed from a first sheet feeding unit and one set of second sheets fed from a second sheet feeding unit to a first sheet stacking unit, the apparatus comprising:

a setting unit configured to set the number of sheets included in one set of the second sheets;

a receiving unit configured to receive, from a user, a confirmation request of the second sheets after feeding of the first sheet from the first sheet feeding unit for the job or feeding of the second sheet from the second sheet feeding unit for the job; and a control unit configured to control to output, after the receiving unit has received the confirmation request and before the job is completed, the set number of second sheets fed from the second sheet feeding unit to a second sheet stacking unit different from the first sheet stacking unit.

2. The apparatus according to claim 1, further comprising:

a counting unit configured to count the number of the second sheets fed from the second sheet feeding unit;

a determining unit configured to determine, in a case where image formation is performed on a plurality of copies of the first sheets, whether the counted number of the second sheets agrees with the set number of the second sheets after the image of a part of the plurality of copies of the first sheets has been formed; and a display unit configured to perform a display that requests a user to confirm the second sheets in a case where the counted number of the second sheets disagrees with the set number of the second sheets.

3. The apparatus according to claim 2, further comprising:

a suspending unit configured to suspend image formation of a following set of the first sheets in the case where the counted number of the second sheets disagrees with the set number of the second sheets.

4. The apparatus according to claim 1, wherein the second sheets are inserted into the first sheets.

5. The apparatus according to claim 1, wherein the second sheet includes at least one of a preprint sheet, an index sheet, and a tab-attached sheet.

6. The apparatus according to claim 1, wherein the first sheet is not outputted while the control unit controls to output the set number of second sheets fed from the second sheet feeding unit.

7. A method for controlling an apparatus which executes a job for outputting first sheets fed from a first sheet feeding unit and one set of second sheets fed from a second sheet feeding unit to a first sheet stacking unit, the control method comprising:

setting the number of sheets included in one set of the second sheets;

receiving, from a user, a confirmation request of the second sheets after feeding of the first sheet from the first sheet feeding unit for the job or feeding of the second sheet from the second sheet feeding unit for the job; and performing control to output, after the confirmation request is received and before the job is completed, the set number of second sheets fed from the second sheet feeding unit to a second sheet stacking unit different from the first sheet stacking unit.

8. The method according to claim 7, further comprising:

counting a number of the second sheets fed from the second sheet feeding unit;

determining, in a case where image formation is performed on a plurality of copies of the first sheets, whether the counted number of the second sheets agrees with the set number of the second sheets after the image of a part of the plurality of copies of the first sheets has been formed; and performing a display that requests a user to confirm the second sheets in a case where the counted number of the second sheets disagrees with the set number of the second sheets.

9. The method according to claim 8, further comprising:

suspending image formation of a following set of the first sheets in the case where the count number of the second sheets disagrees with the set number of the second sheets.

10. The method according to claim 7, further comprising inserting the second sheets into the first sheets.

11. The method according to claim 7, wherein the second sheet includes at least one of a preprint sheet, an index sheet, and a tab-attached sheet.

12. The method according to claim 7, wherein the first sheet is not outputted while the set number of second sheets fed from the second sheet feeding unit are output.

13. A computer readable medium, executable by a computer, containing instructions for controlling an apparatus which executes a job for outputting first sheets fed from a first sheet feeding unit and one set of second sheets fed from a second sheet feeding unit to a first sheet stacking unit, the second sheets including a plurality of set of sheets, the storage medium comprising:

a code to set the number of sheets included in one set of the second sheets;

a code to receive, from a user, a confirmation request of the second sheets after feeding of the first sheet from the first sheet feeding unit for the job or feeding of the second sheet from the second sheet feeding unit for the job; and a code to perform control to output, after the confirmation request is received and before the job is completed, the set number of second sheets fed from the second sheet feeding unit to a second sheet stacking unit different from the first sheet stacking unit.

14. The computer readable medium according to claim 13, further comprising:

a code to count the number of the second sheets fed from the second sheet feeding unit;

a code to determine, in a case where image formation is performed on a plurality of copies of the first sheets, whether the counted number of the second sheets agrees with the set number of the second sheets after the image of a part of the plurality of copies of the first sheets has been formed; and a code to perform a display that requests a user to confirm the second sheets in a case where the counted number of the second sheets disagrees with the set number of the second sheets.

15. The computer readable medium according to claim 14, further comprising:

a code to suspend image formation of a following set of the first sheets in the case where the counted number of the second sheets disagrees with the set number of the second sheets.

16. The computer readable medium according to claim 14, wherein the first sheet is not outputted while the set number of second sheets fed from the second sheet feeding unit are output.

17. The computer readable medium according to claim 13, further comprising a code to insert the second sheets into the first sheets.

* * * * *